US008289251B2

(12) United States Patent
Tsubata

(10) Patent No.: US 8,289,251 B2
(45) Date of Patent: Oct. 16, 2012

(54) LIQUID CRYSTAL DISPLAY APPARATUS, DRIVER CIRCUIT, DRIVING METHOD AND TELEVISION RECEIVER

(75) Inventor: Toshihide Tsubata, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 911 days.

(21) Appl. No.: 12/308,181

(22) PCT Filed: Apr. 24, 2007

(86) PCT No.: PCT/JP2007/058855

§ 371 (c)(1),
(2), (4) Date: Dec. 9, 2008

(87) PCT Pub. No.: WO2008/038431

PCT Pub. Date: Apr. 3, 2008

(65) Prior Publication Data

US 2009/0303166 A1 Dec. 10, 2009

(30) Foreign Application Priority Data

Sep. 28, 2006 (JP) ..... 2006-264882

(51) Int. Cl.
*G09G 3/36* (2006.01)

(52) U.S. Cl. ..... 345/87; 345/89; 345/92; 345/100; 349/39

(58) Field of Classification Search ..... 345/87, 345/89, 92, 98, 100; 349/39, 41
See application file for complete search history.

(56) References Cited

U.S. PATENT DOCUMENTS 4,488,150 A 12/1984 Kanatani
5,903,234 A 5/1999 Kimura
6,046,790 A 4/2000 Hara et al.
(Continued)

FOREIGN PATENT DOCUMENTS

EP 1 235 199 8/2002
(Continued)

OTHER PUBLICATIONS

Notice of Allowance dated Mar. 15, 2012, issued in co-pending U.S. Appl. No. 12/226,605.

(Continued)

*Primary Examiner* — Amare Mengistu
*Assistant Examiner* — Premal Patel
(74) *Attorney, Agent, or Firm* — Harness, Dickey & Pierce, P.L.C.

(57) ABSTRACT

In one embodiment of the present invention, in a liquid crystal display apparatus, while the complication of a driver circuit, etc., and an increase in operating frequency are suppressed, impulse display is implemented and the charge characteristics of pixel capacitances are improved. In an active matrix-type liquid crystal display apparatus of at least one embodiment, during a precharge period provided for each horizontal period, a precharge voltage or of the same polarity as that of a data signal provided during an effective scanning period immediately after the precharge period is provided to a source line. In each frame period, during a precharge period which is after the lapse of a predetermined period from the start of application of a pixel data write pulse to a gate line, and during which a precharge voltage of the same polarity as that of the data signal provided during a period of a next pixel data write pulse is provided to the source line, a black voltage application pulse is applied to the gate line. Accordingly, along with black insertion for implementing impulse display, pixel capacitances are precharged.

29 Claims, 16 Drawing Sheets

U.S. PATENT DOCUMENTS

| | | | |
|---|---|---|---|
| 6,473,077 | B1 | 10/2002 | Takenaka et al. |
| 6,642,916 | B1 | 11/2003 | Kodama et al. |
| 6,876,349 | B2 | 4/2005 | Edwards et al. |
| 6,937,224 | B1 | 8/2005 | Miyachi |
| 7,369,124 | B2 | 5/2008 | Nakano et al. |
| 7,843,410 | B2 | 11/2010 | Floyd |
| 2002/0118154 | A1 | 8/2002 | Kim |
| 2002/0175905 | A1 | 11/2002 | Matsumoto |
| 2003/0011696 | A1 | 1/2003 | Yamazaki |
| 2003/0058229 | A1 | 3/2003 | Kawabe et al. |
| 2003/0090449 | A1 | 5/2003 | Arimoto et al. |
| 2003/0151572 | A1 | 8/2003 | Kumada et al. |
| 2004/0017344 | A1 | 1/2004 | Takemoto |
| 2004/0041763 | A1 | 3/2004 | Kodama et al. |
| 2004/0104881 | A1 | 6/2004 | Furuya |
| 2004/0217931 | A1 | 11/2004 | Shin |
| 2005/0017935 | A1 | 1/2005 | Hirama |
| 2005/0083278 | A1 | 4/2005 | Teraishi |
| 2005/0122321 | A1 | 6/2005 | Akai et al. |
| 2005/0151714 | A1 | 7/2005 | Hirama |
| 2005/0219196 | A1 | 10/2005 | Lee |
| 2006/0001628 | A1 | 1/2006 | Kawaguchi |
| 2006/0028463 | A1 | 2/2006 | Nakamura et al. |
| 2006/0050043 | A1 | 3/2006 | Kawagoe |
| 2006/0055661 | A1 | 3/2006 | Kawaguchi |
| 2006/0061540 | A1 | 3/2006 | Harada |
| 2006/0262071 | A1 | 11/2006 | Shieh et al. |
| 2007/0018923 | A1 | 1/2007 | Yokota |
| 2007/0030230 | A1 | 2/2007 | Lee |
| 2008/0001876 | A1 | 1/2008 | Ito et al. |

FOREIGN PATENT DOCUMENTS

| | | |
|---|---|---|
| EP | 1 286 202 | 2/2003 |
| EP | 1 424 589 | 6/2004 |
| GB | 2 429 569 | 2/2007 |
| JP | 04-042211 | 2/1992 |
| JP | 09-243998 | 9/1997 |
| JP | 10-011032 | 1/1998 |
| JP | 11-30975 | 2/1999 |
| JP | 11-085115 | 3/1999 |
| JP | 2000-122596 | 4/2000 |
| JP | 2000-148098 | 5/2000 |
| JP | 2000-267141 | 9/2000 |
| JP | 2000-321551 | 11/2000 |
| JP | 2001-60078 | 3/2001 |
| JP | 2001-100212 | 4/2001 |
| JP | 2002-62855 | 2/2002 |
| JP | 2002-175057 | 6/2002 |
| JP | 2002-268613 | 9/2002 |
| JP | 2002-328654 | 11/2002 |
| JP | 2003-022058 | 1/2003 |
| JP | 2003-66918 | 3/2003 |
| JP | 2003-140624 | 5/2003 |
| JP | 2003-177720 | 6/2003 |
| JP | 2003-302951 | 10/2003 |
| JP | 2004-279626 | 10/2004 |
| JP | 2004-334171 | 11/2004 |
| JP | 2005-12911 | 5/2005 |
| JP | 2006-72078 | 3/2006 |
| JP | 2007-41548 | 2/2007 |
| WO | WO 03/091790 | 11/2003 |

OTHER PUBLICATIONS

Office Action by the Japanese Patent Office dated May 31, 2011 for corresponding Japanese Patent Application JP 61-228491 with machine translation.

U.S. Office Action dated Sep. 29, 2011, issued in co-pending U.S. Appl. No. 12/226,056.

U.S. Office Action dated Oct. 20, 2011, issued in co-pending U.S. Appl. No. 11/922,756.

Notice of Allowance dated Sep. 23, 2011, issued in co-pending U.S. Appl. No. 12/311,968.

Notice of Allowance dated Oct. 7, 2011, issued in co-pending U.S. Appl. No. 11/922,758.

European Search dated Sep. 29, 2010 for corresponding European Patent Application.

English translation of Chinese Office Action dated Dec. 16, 2010 for corresponding Application No. 200780022213.2.

Notice of Allowance dated Apr. 19, 2012, issued in co-pending U.S. Appl. No. 12/226,056.

LIQUID CRYSTAL DISPLAY APPARATUS, DRIVER CIRCUIT, DRIVING METHOD AND TELEVISION RECEIVER

TECHNICAL FIELD

The present invention relates to an active matrix-type liquid crystal display apparatus using switching elements like thin-film transistors.

BACKGROUND ART

In an impulse-type display apparatus such as a CRT (Cathode Ray Tube), when taking a look at individual pixels, a light-on period during which an image is displayed and a light-off period during which an image is not displayed are alternately repeated. For example, also in a case where display of a moving image is performed, a light-off period is inserted when rewrite of an image for one screen is performed, and thus human vision does not perceive an after-image of a moving object. Hence, a background and an object can be clearly distinguished from each other and a moving image is viewed without any unnatural feeling.

On the other hand, in a hold-type display apparatus such as a liquid crystal display apparatus using TFTs (Thin Film Transistors), luminance of an individual pixel is determined by a voltage held in each pixel capacitance. When a voltage held in a pixel capacitance is once rewritten, the voltage is maintained for one frame period. As such, in a hold-type display apparatus, when a voltage to be held in a pixel capacitance as pixel data is once written, the voltage is held until the next time the voltage is rewritten. Thus, an image of each frame temporally approximates an image of its previous frame. Accordingly, when a moving image is displayed, human vision perceives an after-image of a moving object. For example, as shown in FIG. 21, an after-image AI occurs such that an image OI representing a moving object leaves a trail (such an after-image is hereinafter referred to as a "trailing after-image").

In a hold-type display apparatus such as an active matrix-type liquid crystal display apparatus, such a trailing after-image occurs when a moving image is displayed, and thus, conventionally it is common practice to adopt an impulse-type display apparatus for a display of a television set, etc., on which moving-image display is mainly performed. However, in recent years, there have been strong demands for weight reduction and slimming down of a display of a television set, etc. Hence, for such a display, adoption of a hold-type display apparatus, such as a liquid crystal display apparatus, with which weight reduction and slimming down are easily achieved has been rapidly promoted.

Patent Document 1: Japanese Unexamined Patent Publication No. 9-243998

Patent Document 2: Japanese Unexamined Patent Publication No. 11-85115

Patent Document 3: Japanese Unexamined Patent Publication No. 2002-175057

Patent Document 4: Japanese Unexamined Patent Publication No. 2003-66918

Patent Document 5: Japanese Unexamined Patent Publication No. 2004-61590

Patent Document 6: Japanese Unexamined Patent Publication No. 2005-121911

DISCLOSURE OF THE INVENTION

Problems to be Solved by the Invention

For a method for improving the above-described trailing after-image in a hold-type display apparatus such as an active matrix-type liquid crystal display apparatus, a method is known in which display performed on a liquid crystal display apparatus is caused to implement (pseudo) impulse by, for example, inserting a period where black display is performed in one frame period (hereinafter, referred to as "black insertion") (e.g., Japanese Unexamined Patent Publication No. 2003-66918 (Patent Document 4)).

However, implementation of impulse by conventional methods in an active matrix-type liquid crystal display apparatus which is a hold-type display apparatus complicates a driver circuit, etc., due to black insertion, and also increases the operating frequency of the driver circuit and accordingly reduces the time that can be secured to charge pixel capacitances.

Also, Japanese Unexamined Patent Publication No. 2002-175057 (Patent Document 3) discloses a liquid crystal display apparatus in which each gate line (scanning signal line) is selected at least twice in one frame period and to pixels connected to the gate line is written, at lease once, each of an erase voltage for uniforming the states of the respective pixels and a gradation voltage corresponding to an image to be displayed. According to the liquid crystal display apparatus, an after-image of a displayed image is suppressed and excellent moving-image display can be obtained. However, in the liquid crystal display apparatus, a voltage to be supplied to a source line is alternately switched between a gradation voltage that is based on an image signal and a blackening voltage and a period during which each gate line is selected for application of a gradation voltage is such a period of time that is a further half of the time obtained by dividing one frame period by the number of gate lines. That is, the time for charging pixel capacitances by a gradation voltage is reduced.

Furthermore, since in recent years an improvement in resolution has been promoted in active matrix-type liquid crystal display apparatuses, the charging time that can be secured for write of pixel data in pixel capacitances tends to be reduced. When the charging time is reduced, there is a possibility that due to insufficient charge, proper pixel data cannot be written in pixel capacitances.

Meanwhile, in a liquid crystal display apparatus of a dot inversion drive scheme (hereinafter, referred to as a "2H dot inversion drive scheme") in which the polarity of a data signal is reversed every two horizontal periods, in order to reduce power consumption, a charge sharing scheme may be adopted in which adjacent data signal lines are short-circuited upon polarity reversal of data signals (e.g., Japanese Unexamined Patent Publication No. 9-243998 (Patent Document 1)). In this case, a difference may occur in the amount of charge on a pixel capacitance between two lines which are the unit of polarity reversal and accordingly line-like transverse unevenness may be visually identified. To cope with this, a method is proposed of uniforming charge characteristics by allowing a data signal to have a certain intermediate potential between positive polarity and negative polarity potentials during a blanking period of every horizontal period (Japanese Patent Unexamined Patent Publication No. 2004-61590 (Patent Document 5)). However, when it becomes difficult to secure a sufficient charging time or charge sharing period due to the promotion of implementation of high resolution or the increase in drive frequency for impulse, even if such a method is adopted, the difference in the amount of charge on a pixel capacitance between two lines which are the unit of polarity reversal is not sufficiently canceled out, and thus, there is a possibility that line-like transverse unevenness may be visually identified.

It is therefore an object of the present invention to provide a liquid crystal display apparatus capable of implementing (pseudo) impulse display while suppressing the complication of a driver circuit etc. and an increase in operating frequency, and capable of improving the charge characteristics of pixel capacitances, and a driver circuit and a driving method therefor.

Means for Solving the Problems

A first aspect of the present invention provides an active matrix-type liquid crystal display apparatus including:

a plurality of data signal lines;

a plurality of scanning signal lines intersecting the plurality of data signal lines;

a plurality of pixel formation portions arranged in a matrix form so as to correspond to respective intersection points of the plurality of data signal lines and the plurality of scanning signal lines; and a driver circuit for driving the plurality of data signal lines and the plurality of scanning signal lines, wherein the driver circuit includes:

a data signal line driver circuit for generating a plurality of data signals representing an image to be displayed, as voltage signals whose polarities are reversed every predetermine number of horizontal periods, and applying the plurality of data signals to the plurality of data signal lines;

a precharge circuit for providing, as a precharge voltage, a predetermined positive-polarity or negative-polarity voltage to the plurality of data signal lines during a predetermined precharge period, every one or more predetermined number of horizontal periods; and a scanning signal line driver circuit for selectively driving the plurality of scanning signal lines such that each of the plurality of scanning signal lines is in a selected state during an effective scanning period which is a period other than the precharge period, at least once in each frame period, and the scanning signal line having been in the selected state during the effective scanning period is in a selected state during the precharge period, at least once in a period from a first point in time at which the scanning signal line is changed from the selected state to a non-selected state to a second point in time at which the scanning signal line goes into a selected state during an effective scanning period in a next frame period, each of the plurality of pixel formation portions includes:

a switching element that is in an on state when a scanning signal line passing through a corresponding intersection point is in a selected state, and is in an off state when the scanning signal line is in a non-selected state; and a pixel capacitance connected, through the switching element, to a data signal line passing through the corresponding intersection point, and the driver circuit applies the precharge voltage to each data signal line by the precharge circuit and selects each scanning signal line by the scanning signal line driver circuit, such that a polarity of the precharge voltage provided to each data signal line when any one of the scanning signal lines is caused to be in a selected state during the precharge period in each frame period matches a polarity of a data signal applied to the data signal line when the scanning signal line is caused to be in a selected state during the effective scanning period in a next frame period.

A second aspect of the present invention provides the liquid crystal display apparatus according to the first aspect of the present invention, wherein the precharge circuit reverses a polarity of the precharge voltage to be provided to each data signal line, in response to polarity reversal of a data signal to be applied to the data signal line.

A third aspect of the present invention provides the liquid crystal display apparatus according to the second aspect of the present invention, wherein the precharge circuit:

generates the precharge voltage to be provided to each data signal line, such that a polarity of the precharge voltage provided to each data signal line during each precharge period matches a polarity of a data signal applied to the data signal line immediately after the precharge period, and provides the precharge voltage to each data signal line using a predetermined period as the precharge period when a polarity of each data signal is reversed.

A fourth aspect of the present invention provides the liquid crystal display apparatus according to the first aspect of the present invention, wherein the scanning signal line driver circuit causes the scanning signal line having been in the selected state during the effective scanning period to be in a selected state during the precharge period, a plurality of times in the period from the first point in time to the second point in time.

A fifth aspect of the present invention provides the liquid crystal display apparatus according to the fourth aspect of the present invention, wherein the precharge circuit reverses a polarity of the precharge voltage to be provided to each data signal line, in response to polarity reversal of a data signal to be applied to the data signal line, and the scanning signal line driver circuit causes the scanning signal line having been in the selected state during the effective scanning period to be in a selected state during the precharge period, the plurality of times in the period from the first point in time to the second point in time, at intervals of twice the predetermined number of horizontal periods, the predetermined number of horizontal periods constituting a cycle of polarity reversal of the plurality of data signals.

A sixth aspect of the present invention provides the liquid crystal display apparatus according to the first aspect of the present invention, wherein the data signal line driver circuit generates the plurality of data signals such that polarities of the data signals are reversed every two or more predetermined number of horizontal periods, and the precharge circuit provides the precharge voltage to the plurality of data signal lines during the precharge period, every horizontal period.

A seventh aspect of the present invention provides the liquid crystal display apparatus according to the sixth aspect of the present invention, wherein the scanning signal line driver circuit causes the scanning signal line having been in the selected state during the effective scanning period to be in a selected state during a precharge period where polarities of the plurality of data signals are not reversed, in the period from the first point in time to the second point in time.

An eighth aspect of the present invention provides the liquid crystal display apparatus according to the first aspect of the present invention, wherein when the scanning signal line driver circuit causes any one of the plurality of scanning signal lines to be in a selected state during the effective scanning period, the scanning signal line driver circuit selects the any one of the plurality of scanning signal lines such that a period of the selected state does not overlap with the precharge period.

A ninth aspect of the present invention provides the liquid crystal display apparatus according to the first aspect of the present invention, further including a display control circuit for controlling the driver circuit, wherein the precharge circuit includes:

a first switching element group for interrupting application of the plurality of data signals to the plurality of data signal lines when in an off state;

a second switching element group composed of switching elements connected to one of two data signal line groups obtained by grouping the plurality of data signal lines such that a data signal line group to which data signals of a same polarity are applied is treated as one group;

a third switching element group composed of switching elements connected to other one of the two data signal line groups; and a precharge signal generating circuit for generating a precharge signal in which a positive-polarity voltage and a negative-polarity voltage serving as the precharge voltages alternately appear, and providing the precharge signal to the one data signal line group through the second switching element group when the second switching element group is in an on state; and generating a reversed precharge signal obtained by reversing a polarity of the precharge voltage and providing the reversed precharge signal to the other data signal line group through the third switching element group when the third switching element group is in an on state, and the display control circuit causes, during the precharge period, the first switching element group to be in an off state and the second and third switching element groups to be in an on state, and causes, during periods other than the precharge period, the first switching element group to be in an on state and the second and third switching element groups to be in an off state.

A tenth aspect of the present invention provides the liquid crystal display apparatus according to the ninth aspect of the present invention, wherein the display control circuit generates, as a polarity reversal signal, a control signal for causing the data signal line driver circuit to reverse polarities of the plurality of data signals every the predetermined number of horizontal periods, and the precharge signal generating circuit generates the precharge signal such that a polarity of the precharge signal is reversed according to the polarity reversal signal.

An eleventh aspect of the present invention provides the liquid crystal display apparatus according to the first aspect of the present invention, wherein the precharge period is shorter than a period during which the plurality of data signals representing the image are applied to the plurality of data signal lines.

A twelfth aspect of the present invention provides the liquid crystal display apparatus according to the first aspect of the present invention, wherein each of the plurality of pixel formation portions is configured to form a black pixel when a voltage is not applied to a corresponding pixel capacitance, and the precharge voltage is a voltage corresponding to black display.

A thirteenth aspect of the present invention provides the liquid crystal display apparatus according to the first aspect of the present invention, wherein the data signal line driver circuit generates the plurality of data signals such that data signals to be respectively applied to adjacent data signal lines have different polarities, the driver circuit includes a circuit for interrupting application of the plurality of data signals to the plurality of data signal lines during a predetermined period, every one or more predetermined number of horizontal periods, and short-circuiting the plurality of data signal lines during a predetermined charge sharing period included in the predetermined period, and the precharge period is included in the predetermined period during which the application of the plurality of data signals to the plurality of data signal lines is interrupted, and is a period following the charge sharing period.

A fourteenth aspect of the present invention provides the liquid crystal display apparatus according to the first aspect of the present invention, wherein the data signal line driver circuit includes:

a plurality of buffers for outputting the plurality of data signals to be applied to the plurality of data signal lines; and a pause control part for causing the plurality of buffers to pause during the precharge period.

A fifteenth aspect of the present invention provides the liquid crystal display apparatus according to the first aspect of the present invention, further including:

a lighting device configured to be able to be partially turned on/off for throwing light onto the plurality of pixel formation portions; and a lighting control part for controlling turning on and off of the lighting device according to selection of each scanning signal line, wherein the plurality of pixel formation portions share a liquid crystal layer and control an amount of transmission of light from the lighting device through the liquid crystal layer, according to voltages held in the pixel capacitances respectively included therein, and thereby form the image, and the lighting control part controls turning on and off of the lighting device such that light is thrown from the lighting device onto a pixel formation portion including a pixel capacitance that is charged by any one of the plurality of data signals with any one of the plurality of scanning signal lines caused to be in a selected state during the effective scanning period, and light is not thrown from the lighting device onto a pixel formation portion including a pixel capacitance that is charged by the precharge voltage with any one of the plurality of scanning signal lines caused to be in a selected state during the precharge period.

A sixteenth aspect of the present invention provides the liquid crystal display apparatus according to the fifteenth aspect of the present invention, wherein the precharge voltage is a voltage for providing a pretilt angle to liquid crystal molecules in the liquid crystal layer.

A seventeenth aspect of the present invention provides a television receiver including the liquid crystal display apparatus according to the first aspect of the present invention.

An eighteenth aspect of the present invention provides a driver circuit of an active matrix-type liquid crystal display apparatus including a plurality of data signal lines; a plurality of scanning signal lines intersecting the plurality of data signal lines; and a plurality of pixel formation portions arranged in a matrix form so as to correspond to respective intersection points of the plurality of data signal lines and the plurality of scanning signal lines, the driver circuit including:

a data signal line driver circuit for generating a plurality of data signals representing an image to be displayed, as voltage signals whose polarities are reversed every predetermine number of horizontal periods, and applying the plurality of data signals to the plurality of data signal lines;

a precharge circuit for providing, as a precharge voltage, a predetermined positive-polarity or negative-polarity voltage to the plurality of data signal lines during a predetermined precharge period, every one or more predetermined number of horizontal periods; and a scanning signal line driver circuit for selectively driving the plurality of scanning signal lines such that each of the plurality of scanning signal lines is in a selected state during an effective scanning period which is a period other than the precharge period, at least once in each frame period, and the scanning signal line having been in the selected state during the effective scanning period is in a selected state during the precharge period, at least once in a period from a first point in time at which the scanning signal line is changed from the selected state to a non-selected state to a second point in time at which the scanning signal line goes into a selected state during an effective scanning period in a next frame period, wherein each of the plurality of pixel formation portions includes:

a switching element that is in an on state when a scanning signal line passing through a corresponding intersection point is in a selected state, and is in an off state when the scanning signal line is in a non-selected state; and a pixel capacitance connected, through the switching element, to a data signal line passing through the corresponding intersection point, and the precharge voltage is applied to each data signal line by the precharge circuit and each scanning signal line is selected by the scanning signal line driver circuit, such that a polarity of the precharge voltage provided to each data signal line when any one of the scanning signal lines is caused to be in a selected state during the precharge period in each frame period matches a polarity of a data signal applied to the data signal line when the scanning signal line is caused to be in a selected state during the effective scanning period in a next frame period.

A nineteenth aspect of the present invention provides a driving method for an active matrix-type liquid crystal display apparatus including a plurality of data signal lines; a plurality of scanning signal lines intersecting the plurality of data signal lines; and a plurality of pixel formation portions arranged in a matrix form so as to correspond to respective intersection points of the plurality of data signal lines and the plurality of scanning signal lines, the driving method including:

a data signal line driving step of generating a plurality of data signals representing an image to be displayed, as voltage signals whose polarities are reversed every predetermine number of horizontal periods, and applying the plurality of data signals to the plurality of data signal lines;

a precharging step of providing, as a precharge voltage, a predetermined positive-polarity or negative-polarity voltage to the plurality of data signal lines during a predetermined precharge period, every one or more predetermined number of horizontal periods; and a scanning signal line driving step of selectively driving the plurality of scanning signal lines such that each of the plurality of scanning signal lines is in a selected state during an effective scanning period which is a period other than the precharge period, at least once in each frame period, and the scanning signal line having been in the selected state during the effective scanning period is in a selected state during the precharge period, at least once in a period from a first point in time at which the scanning signal line is changed from the selected state to a non-selected state to a second point in time at which the scanning signal line goes into a selected state during an effective scanning period in a next frame period, wherein each of the plurality of pixel formation portions includes:

a switching element that is in an on state when a scanning signal line passing through a corresponding intersection point is in a selected state, and is in an off state when the scanning signal line is in a non-selected state; and a pixel capacitance connected, through the switching element, to a data signal line passing through the corresponding intersection point, and the precharge voltage is applied to each data signal line in the precharging step and each scanning signal line is selected in the scanning signal line driving step, such that a polarity of the precharge voltage provided to each data signal line when any one of the scanning signal lines is caused to be in a selected state during the precharge period in each frame period matches a polarity of a data signal applied to the data signal line when the scanning signal line is caused to be in a selected state during the effective scanning period in a next frame period.

Other aspects of the present invention are clear from the description of the above-described aspects and the following embodiment of the present invention and thus description thereof is not given.

Effects of the Invention

According to the first aspect of the present invention, during each precharge period, a precharge voltage is provided to each data signal line and each scanning signal line is in a selected state during a precharge period at least once in a period from when being selected during an effective scanning period for write of pixel data of an image to be displayed until going into a selected state during an effective scanning period in a next frame period. Accordingly, until the scanning signal line goes into a selected state next during an effective scanning period for pixel data write, the precharge voltage is held in a pixel capacitance of a pixel formation portion connected to the scanning signal line. Here, when a voltage corresponding to black display is selected as the precharge voltage, without reducing the charge period of a pixel capacitance for pixel data write, by implementation of impulse by securing a sufficient black insertion period, the display performance of a moving image can be improved. The polarity of a precharge voltage provided to each data signal line when anyone of the scanning signal lines is caused to be in a selected state during a precharge period matches the polarity of a data signal applied to the data signal line when the scanning signal line is caused to be in a selected state during an effective scanning period in a next frame period. Hence, by the selection of a scanning signal line during a precharge period, precharge on a pixel capacitance is performed. Accordingly, in an active matrix-type liquid crystal display apparatus, while the complication of a driver circuit etc. and an increase in operating frequency are suppressed, (pseudo) impulse display can be implemented and the charge rate of pixel capacitances can be improved.

According to the second aspect of the present invention, since the polarity of a precharge voltage to be provided to each data signal line is reversed in response to polarity reversal of a data signal to be applied to the data signal line, setting of a period during which a scanning signal line is to be selected for precharge on a pixel capacitance is facilitated. In addition, the polarity of a precharge voltage provided to each data signal line during each precharge period can be made to match the polarity of a data signal provided to the data signal line during an effective scanning period that is immediately after the precharge period; accordingly, by precharge on each data signal line, the charge rate can be increased.

According to the third aspect of the present invention, a precharge voltage is provided to each data signal line using a predetermined period as a precharge period when the polarity of each data signal is reversed, and the polarity of the precharge voltage matches the polarity of a data signal applied to the data signal line immediately after the precharge period. By such precharge on the data signal lines, the charge rate of pixel capacitances can be further increased and also the power consumption of the data signal line driver circuit can be reduced.

According to the fourth aspect of the present invention, a scanning signal line caused to be in a selected state during an effective scanning period is caused to be in a selected state during a precharge period, a plurality of times in a period from a first point in time at which the selected state changes to a non-selected state to a second point in time at which the scanning signal line goes into a selected state during an effective scanning period in a next frame period. Accordingly, immediately before the effective scanning period (immediately before pixel data write) in the next frame period, in a pixel capacitance to which a data signal as pixel data is to be provided during the effective scanning period, a precharge voltage of the same polarity as that of the data signal can be securely held. Also, when impulse display is implemented by selecting, as the precharge voltage, a voltage corresponding to black display, display luminance can be brought to a sufficient black level in a black display period for implementing impulse.

According to the fifth aspect of the present invention, the polarity of a precharge voltage to be provided to each data signal line is reversed in response to polarity reversal of a data signal to be applied to the data signal line, and a scanning signal line caused to be in a selected state during an effective scanning period is caused to be in a selected state during a precharge period, a plurality of times in the period from the first point in time to the second point in time, at intervals of twice a predetermined number of horizontal periods constituting a cycle of polarity reversal of the data signals. Hence, a precharge voltage of the same polarity is provided to each data signal line during precharge periods corresponding to the plurality of selected states. Accordingly, a pixel capacitance is securely precharged. Also, when impulse display is implemented by selecting, as the precharge voltage, a voltage corresponding to black display, display luminance can be securely brought to a black level in a black display period for implementing impulse.

According to the sixth aspect of the present invention, while the power consumption of the data signal line driver circuit is reduced by reversing the polarity of each data signal every two or more predetermined number of horizontal periods, by providing a precharge voltage to each data signal line during a precharge period every horizontal period the charge conditions of pixel capacitances are uniformed, enabling to prevent occurrence of transverse unevenness in display.

According to the seventh aspect of the present invention, since a scanning signal line is caused to be in a selected state during a precharge period where the polarities of data signals are not reversed, the voltages of data signal lines are stable during the precharge period where the scanning signal line is caused to be in a selected state. Accordingly, by the selection of a scanning signal line during a precharge period, a pixel capacitance can be efficiently precharged.

According to the eighth aspect of the present invention, when a scanning signal line is caused to be in a selected state during an effective scanning period, a period of the selected state does not overlap with a precharge period, and thus, charge on pixel capacitances by data signals representing pixel data of an image to be displayed is not hindered by precharge on the data signal lines.

A ninth aspect of the present invention, the data signal lines in a display part are grouped into two sets such that a data signal line group to which data signals of the same polarity are applied is treated as one set, and a precharge signal provided to one of the data signal line groups and a precharge signal provided to the other one of the data signal line groups have opposite polarities. Therefore, even when the polarity of a data signal varies between data signal lines as in a dot inversion drive scheme, each data signal line and each pixel capacitance can be precharged by a voltage of an appropriate polarity.

According to the tenth aspect of the present invention, the polarity of a precharge signal (the polarity of a precharge voltage) is reversed in response to polarity reversal of a data signal, based on a polarity reversal signal, and a precharge signal provided to the one data signal line group and a precharge signal provided to the other data signal line group have opposite polarities. Accordingly, setting of a period during which a scanning signal line is to be selected for precharge on a pixel capacitance is facilitated, and even when the polarity of a data signal varies between data signal lines as in a dot inversion drive scheme, each data signal line and each pixel capacitance can be precharged by a voltage of an appropriate polarity.

According to the eleventh aspect of the present invention, since a precharge period which is a period during which a precharge voltage is applied to data signal lines is shorter than a period (data signal period) during which data signals representing an image to be displayed are applied to the data signal lines, while reduction in the charge period of pixel capacitances for pixel data write is suppressed, impulse display can be implemented. Hence, the aspect of the present invention is effective in the case in which the data signal period is reduced due to an increase in load on data signal lines etc. associated with an increase in screen size or implementation of high definition, or the case in which the data signal period is reduced by a frame frequency increased to further improve the display performance of a moving image.

According to the twelfth aspect of the present invention, since the liquid crystal display apparatus operates in a normally black mode and a precharge voltage results in a voltage (black voltage) corresponding to black display by being set to a value in the neighborhood of a direct-current level of a data signal, impulse display is implemented by precharge on a pixel capacitance by selection of a scanning signal line during a precharge period. Accordingly, compared with the case of a normally white mode where a black voltage reaches a voltage in the neighborhood of a maximum voltage on the positive-polarity side or in the neighborhood of a minimum voltage on the negative-polarity side, impulse display can be more easily performed. Also, since a precharge voltage results in a voltage in the neighborhood of a direct-current level of a data signal, power consumption by write of a black voltage for implementing impulse is reduced.

According to the thirteenth aspect of the present invention provides the liquid crystal display apparatus according to a liquid crystal display apparatus of a scheme in which data signals to be respectively applied to adjacent data signal lines have different polarities, i.e., a dot inversion drive scheme, the data signal lines in the display part are short-circuited during a charge sharing period which is immediately before a precharge period, whereby the potential of each data signal line becomes substantially equal to a direct-current level of the data signal. Accordingly, the amount of potential change in the data signal lines during the precharge period is significantly reduced, and thus, power consumption by a precharge operation can be reduced.

According to the fourteenth aspect of the present invention, during a precharge period during which a precharge voltage is applied to the data signal lines by the precharge circuit, the buffers in the data signal line driver circuit are in a pause state, and thus, the power consumption of the data signal line driver circuit can be reduced.

According to the fifteenth aspect of the present invention, light is thrown from the lighting device onto a pixel formation portion including a pixel capacitance that is charged by any one of data signals with any one of the scanning signal lines in the display part caused to be in a selected state during an effective scanning period, and light is not thrown from the lighting device onto a pixel formation portion including a pixel capacitance that is charged by a precharge voltage with any one of the scanning signal lines in the display part caused to be in a selected state during a precharge period. Accordingly, even when the precharge voltage is not a voltage corresponding to black display, by such control of the lighting device, black insertion is performed and impulse display is implemented. Therefore, flexibility in selecting a precharge voltage increases and, for example, independent of implementing impulse display, with a view to improving charge characteristics, the value of the precharge voltage can be determined. Also, for example, to improve the response speed of a liquid crystal as an electro-optic element, an appropriate voltage for providing a pretilt angle to liquid crystal molecules can be selected as the precharge voltage.

According to the sixteenth aspect of the present invention, while impulse is implemented by such control of the lighting device as described above according to the selection of a scanning signal line, the display performance of a moving image can be further improved by providing a pretilt angle to liquid crystal molecules upon precharge on pixel capacitances.

Effects of other aspects of the present invention are clear from the description of the effects of the above aspects and the following embodiment of the present invention and thus description thereof is not given.

DESCRIPTION OF THE SYMBOLS

| | |
|---|---|
| 10: | TFT (SWITCHING ELEMENT) |
| 31: | OUTPUT BUFFER |
| 33: | INVERTER |
| 34: | POLARITY REVERSING CIRCUIT |
| 35: | PRECHARGE POWER SUPPLY |
| 100: | DISPLAY PART |
| 200: | DISPLAY CONTROL CIRCUIT |
| 300: | SOURCE DRIVER (DATA SIGNAL LINE DRIVER CIRCUIT) |
| 302: | DATA SIGNAL GENERATION PART |
| 304: | OUTPUT PART |
| 400: | GATE DRIVER (SCANNING SIGNAL LINE DRIVER CIRCUIT) |
| 620: | BACKLIGHT (LIGHTING DEVICE) |
| 720: | LIGHT SOURCE DRIVER CIRCUIT (LIGHTING CONTROL PART) |
| 800: | DISPLAY APPARATUS FOR A TELEVISION RECEIVER |
| Cp: | PIXEL CAPACITANCE |
| Ec: | COMMON ELECTRODE |
| SWa: | FIRST MOS TRANSISTOR (FIRST SWITCHING ELEMENT) |
| SWb: | SECOND MOS TRANSISTOR (SECOND SWITCHING ELEMENT) |
| SWc: | THIRD MOS TRANSISTOR (THIRD SWITCHING ELEMENT) |
| SLi: | SOURCE LINE (DATA SIGNAL LINE (i = 1, 2, . . . , N) |
| GLj: | GATE LINE (SCANNING SIGNAL LINE) (j = 1, 2, . . . , M) |
| BLk: | FLUORESCENT LAMP (k = 1, 2, . . . , 8) |
| DA: | DIGITAL IMAGE SIGNAL |
| SSP: | DATA START PULSE SIGNAL |
| SCK: | DATA CLOCK SIGNAL |
| GSP: | GATE START PULSE SIGNAL |
| GCK: | GATE CLOCK SIGNAL |
| Cpr: | PRECHARGE CONTROL SIGNAL |
| Csh: | CHARGE SHARING CONTROL SIGNAL |
| Rev1: | FIRST POLARITY REVERSAL CONTROL SIGNAL |
| Rev2: | SECOND POLARITY REVERSAL CONTROL SIGNAL |
| GOE: | GATE DRIVER OUTPUT CONTROL SIGNAL |
| GOEr: | GATE DRIVER OUTPUT CONTROL SIGNAL (r = 1, 2, . . . , q) |
| S(i): | DATA SIGNAL (i = 1, 2, . . . , N) |
| G(j): | SCANNING SIGNAL (j = 1, 2, . . . , M) |
| Spr1: | FIRST PRECHARGE SIGNAL |

-continued

| DESCRIPTION OF THE SYMBOLS | |
|---|---|
| Spr2: | SECOND PRECHARGE SIGNAL |
| VprP: | POSITIVE-POLARITY PRECHARGE VOLTAGE |
| VprN: | NEGATIVE-POLARITY PRECHARGE VOLTAGE |
| VSdc: | SOURCE CENTER POTENTIAL (DIRECT-CURRENT LEVEL OF A DATA SIGNAL) |
| Pw: | PIXEL DATA WRITE PULSE |
| Pb: | BLACK VOLTAGE APPLICATION PULSE |
| Tdp: | IMAGE DISPLAY PERIOD |
| Tbk: | BLACK DISPLAY PERIOD |
| Tpr: | PRECHARGE PERIOD |
| Tsh: | CHARGE SHARING PERIOD |

BEST MODE FOR CARRYING OUT THE INVENTION

An embodiment of the present invention will be described below with reference to the accompanying drawings.

1. Embodiment

1.1 Overall Configuration

Figure 1:
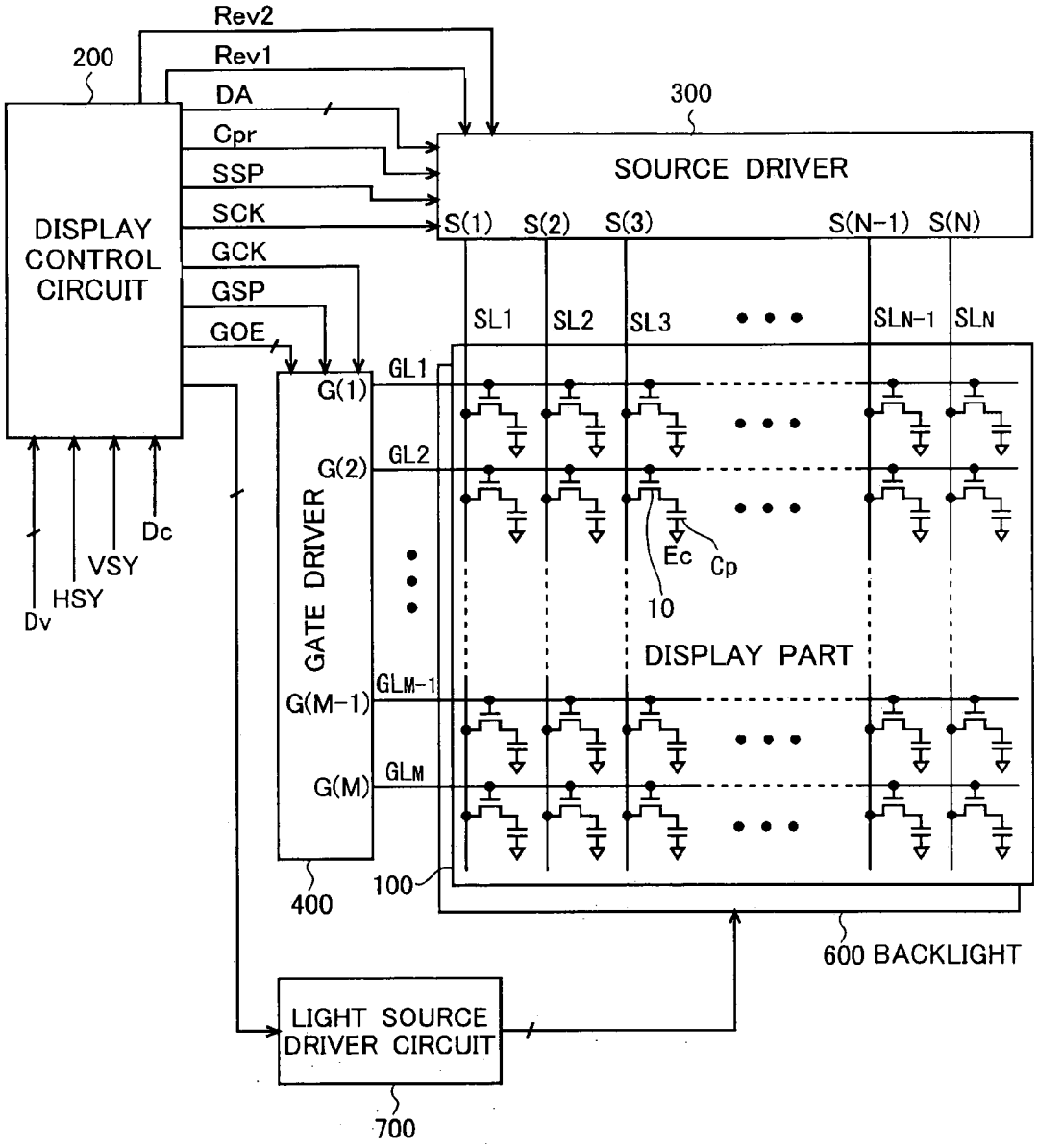
FIG. 1 is a block diagram showing a configuration of a liquid crystal display apparatus according to an embodiment of the present invention, together with an equivalent circuit of a display part thereof.

FIG. 1 is a block diagram showing a configuration of a liquid crystal display apparatus according to an embodiment of the present invention, together with an equivalent circuit of a display part thereof. The liquid crystal display apparatus includes a source driver 300 serving as a data signal line driver circuit; a gate driver 400 serving as a scanning signal line driver circuit; an active matrix-type display part 100; a backlight 600 serving as a planar lighting device; a light source driver circuit 700 for driving the backlight; and a display control circuit 200 for controlling the source driver 300, the gate driver 400, and the light source driver circuit 700. Note that although in the present embodiment the display part 100 is implemented as an active matrix-type liquid crystal panel, a liquid crystal panel may be configured such that the display part 100 is integrally formed with the source driver 300 and the gate driver 400.

The display part 100 of the above-described liquid crystal display apparatus includes a plurality of (M) gate lines GL1 to GLM serving as scanning signal lines; a plurality of (N) source lines SL1 to SLN serving as data signal lines and respectively intersecting the gate lines GL1 to GLM; and a plurality of (M×N) pixel formation portions provided to correspond to respective intersection points of the gate lines GL1 to GLM and the source lines SL1 to SLN. The pixel formation portions are arranged in a matrix form to constitute a pixel array. Each pixel formation portion is composed of a TFT 10 which is a switching element having a gate terminal connected to a gate line GLj passing through a corresponding intersection point and having a source terminal connected to a source line SLi passing through the intersection point; a pixel electrode connected to a drain terminal of the TFT 10; a common electrode Ec which is a counter electrode provided to be shared by the plurality of pixel formation portions; and a liquid crystal layer provided to be shared by the plurality of pixel formation portions and sandwiched between the pixel electrodes and the common electrode Ec. By a liquid crystal capacitance formed by the pixel electrode and the common electrode Ec, a pixel capacitance Cp is constituted. Note that although normally in order to securely hold a voltage in a pixel capacitance an auxiliary capacitance is provided in parallel with a liquid crystal capacitance, the auxiliary capacitance is not directly related to the present invention and thus the description and graphic representation thereof are not given.

To a pixel electrode of each pixel formation portion is provided a potential according to an image to be displayed, by the source driver 300 and the gate driver 400 which operate in a manner described later. To the common electrode Ec is provided a predetermined potential Vcom by a power supply circuit which is not shown. Accordingly, a voltage according to a potential difference between the pixel electrode and the common electrode Ec is applied to a liquid crystal and by the voltage application the amount of transmission of light through the liquid crystal layer is controlled, whereby image display is performed. Note that to control the amount of transmission of light by voltage application to the liquid crystal layer, a polarizing plate is used and in the present embodiment it is assumed that a polarizing plate is arranged so as to obtain normally black. Hence, each pixel formation portion forms a black pixel when a voltage is not applied to a pixel capacitance Cp thereof.

The backlight 600 is a planar lighting device that illuminates the display part 100 from the back, and is composed using, for example, a cold-cathode tube serving as a linear light source, and a light guide plate. The backlight 600 is turned on by being driven by the light source driver circuit 700, whereby light is thrown onto each pixel formation portion of the display part 100 from the backlight 600.

The display control circuit 200 receives, from an external signal source, a digital video signal Dv representing an image to be displayed, a horizontal synchronizing signal HSY and a vertical synchronizing signal VSY provided for the digital video signal Dv, and a control signal Dc for controlling a display operation. Based on the signals Dv, HSY, VSY, and Dc, the display control circuit 200 generates and outputs a data start pulse signal SSP, a data clock signal SCK, a precharge control signal Cpr, first and second polarity reversal control signals Rev1 and Rev2, a digital image signal DA (signal corresponding to the video signal Dv) representing an image to be displayed, a gate start pulse signal GSP, a gate clock signal GCK, and a gate driver output control signal GOE, as signals for displaying an image represented by the digital video signal Dv on the display part 100. More specifically, after performing timing adjustment, etc., on the video signal Dv in an internal memory where necessary, the video signal Dv is outputted as the digital image signal DA from the display control circuit 200. Then, a data clock signal SCK is generated as a signal composed of pulses corresponding to the respective pixels of an image represented by the digital image signal DA. Based on the horizontal synchronizing signal HSY, a data start pulse signal SSP is generated as a signal that goes to a high level (H level) during a predetermined period, every horizontal scanning period. Based on the vertical synchronizing signal VSY, a gate start pulse signal GSP is generated as a signal that goes to an H level during a predetermined period, every frame period (vertical scanning period). Based on the horizontal synchronizing signal HSY, a gate clock signal GCK is generated. Based on the horizontal synchronizing signal HSY and the control signal Dc, a precharge control signal Cpr, first and second polarity reversal control signals Rev1 and Rev2, and gate driver output control signals GOE (GOE1 to GOEq) are generated.

Of the signals generated by the display control circuit 200 in the above-described manner, the digital image signal DA, the precharge control signal Cpr, the data start pulse signal SSP, the data clock signal SCK, and the first and second polarity reversal control signals Rev1 and Rev2 are inputted to the source driver 300, and the gate start pulse signal GSP, the gate clock signal GCK, and the gate driver output control signals GOE are inputted to the gate driver 400.

Based on the digital image signal DA, the data start pulse signal SSP, and the data clock signal SCK, the source driver 300 sequentially generates data signals S(1) to S(N) every horizontal period, as analog voltages corresponding to pixel values for each horizontal scanning line of an image represented by the digital image signal DA, and applies the data signals S(1) to S(N) respectively to the source lines SL1 to SLN.

The gate driver 400 generates scanning signals G(1) to G(M) based on the gate start pulse signal GSP, the gate clock signal GCK, and the gate driver output control signal GOEr (r=1, 2, . . . , q), and applies the scanning signals G(1) to G(M) respectively to the gate lines GL1 to GLM and thereby selectively drives the gate lines GL1 to GLM.

By the source lines SL1 to SLN and the gate lines GL1 to GLM of the display part 100 being driven by the source driver 300 and the gate driver 400 in the above-described manner, voltages of the source lines SLi are respectively provided to pixel capacitances Cp through TFTs 10 connected to a selected gate line GLj (i=1 to N, and j=1 to M). Accordingly, in each pixel formation portion, a voltage according to the digital image signal DA is applied to the liquid crystal layer and by the voltage application, the amount of transmission of light from the backlight 600 is controlled, whereby an image represented by the digital video signal Dv from the external source is displayed on the display part 100.

1.2 Source Driver

The liquid crystal display apparatus according to the present embodiment adopts a drive scheme in which the data signals S(1) to S(N) are outputted such that the polarity of a voltage applied to the liquid crystal layer is reversed every frame period and is also reversed every two gate lines and every source line in each frame, i.e., a 2H dot inversion drive scheme. Therefore, the source driver 300 reverses the polarities of voltages applied to the source lines SL1 to SLN every source line and reverses the polarity of a voltage of a data signal S(i) applied to each source line SLi every two horizontal periods. Here, a potential that serves as a reference for polarity reversal of voltages applied to the source lines is a direct-current level (potential corresponding to a direct-current component) of the data signals S(1) to S(N). Note that the direct-current level does not generally match a direct-current level of the common electrode Ec and is different from the direct-current level of the common electrode Ec by a pull-in voltage ΔVd caused by a parasitic capacitance Cgd between the gate and drain of a TFT in each pixel formation portion. Note, however, that when the pull-in voltage ΔVd caused by the parasitic capacitance Cgd is sufficiently small relative to an optical threshold voltage Vth of the liquid crystal, the direct-current level of the data signals S(1) to S(N) can be considered to be equal to the direct-current level of the common electrode Ec, and thus, it may be considered that the polarities of the data signals S(1) to S(N), i.e., the polarities of voltages applied to the source lines, are reversed every horizontal period, with reference to the potential (counter voltage) of the common electrode Ec.

Figure 2:
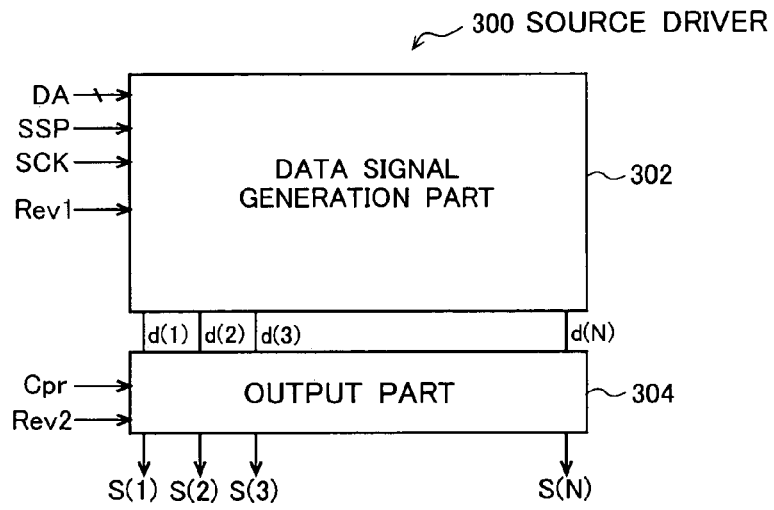
FIG. 2 is a block diagram showing a configuration of a source driver in the embodiment.

FIG. 2 is a block diagram showing a configuration of the source driver 300 in the present embodiment. The source driver 300 is composed of a data signal generation part 302 and an output part 304. Based on the data start pulse signal SSP, the data clock signal SCK, and the first polarity reversal control signal Rev1, the data signal generation part 302 generates, from the digital image signal DA, analog voltage signals respectively for the source lines SL1 to SLN, as internal data signals d(1) to d(N). The configuration of the data signal generation part 302 is the same as that of conventional source drivers and thus description thereof is not given. The output part 304 includes output buffers, each composed of a voltage follower and provided for each internal data signal d(i) generated by the data signal generation part 302. By a corresponding buffer, an analog voltage signal serving as an internal data signals d(i) is impedance-converted and then outputted as a data signal S(i) (i=1, 2, . . . , N).

In the source driver 300, in order to reduce power consumption and to improve the charge characteristics of pixel capacitances Cp, a precharge voltage is provided to each of the source lines SL1 to SLN during a predetermined period upon polarity reversal of data signals S(1) to S(N) and in order to achieve uniformity of a charge condition in 2H dot inversion drive, a precharge voltage is also provided to each of the source lines SL1 to SLN during a predetermined period when a gate line to be selected is switched at a time other than when the polarities of the data signals S(1) to S(N) are reversed. That is, in the present embodiment, a precharge voltage is provided to each of the source lines SL1 to SLN during a predetermined period, every horizontal period (the predetermined period is hereinafter referred to as a "precharge period" and denoted by the symbol "Tpr"). Also, in the present embodiment, to a data signal line SLi to which a positive-polarity data signal S(i) is to be applied is provided a positive-polarity precharge voltage VprP during a precharge period Tpr that is immediately before the application, and to a data signal line SLi to which a negative-polarity data signal S(i) is to be applied is provided a negative-polarity precharge voltage VprN during a precharge period Tpr that is immediately before the application (i=1, 2, . . . , N).

Figure 3:
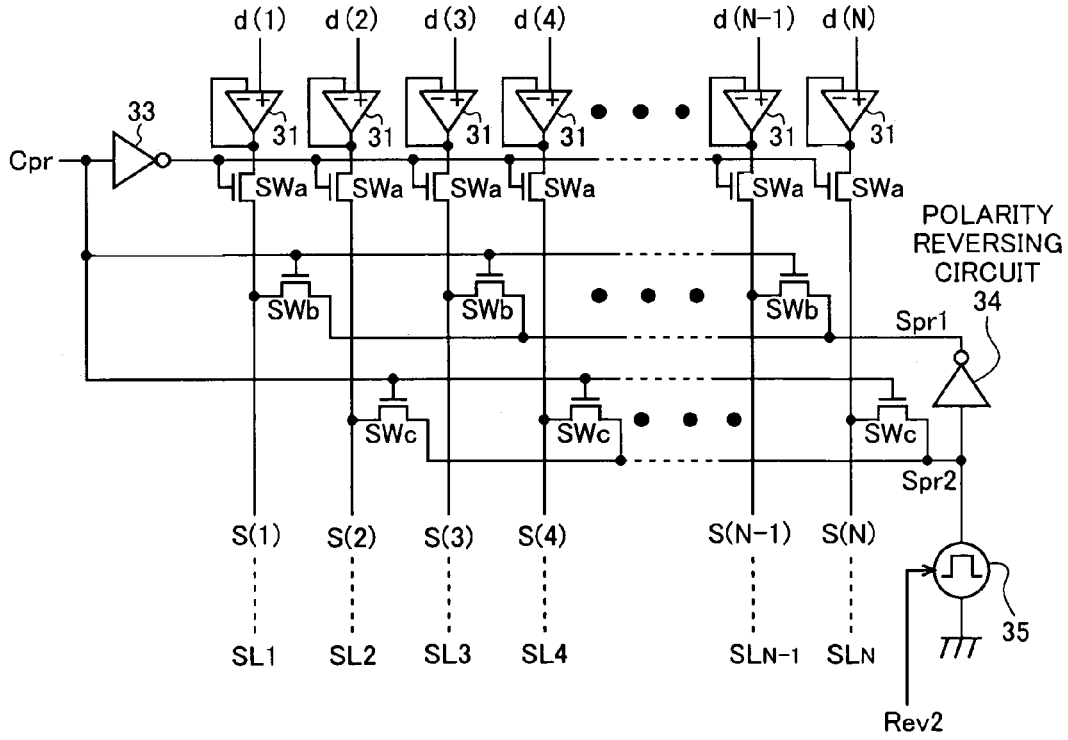
FIG. 3 is a circuit diagram showing a configuration of an output part of the source driver in the embodiment.

To implement such a precharge scheme, the output part 304 of the source driver 300 is configured as shown in FIG. 3. Specifically, the output part 304 receives the analog voltage signals d(1) to d(N) which are internal data signals generated based on the digital image signal DA, and impedance-converts the analog voltage signals d(1) to d(N) and thereby generates data signals S(1) to S(N) as video signals to be transmitted through the source lines SL1 to SLN. The output part 304 has N output buffers 31 as voltage followers for the impedance conversion. A first MOS (Metal Oxide Semiconductor) transistor SWa serving as a switching element is provided to an output terminal of each buffer 31 and the output terminal of each buffer 31 is connected to one of output terminals of the source driver 300 through the first MOS transistor SWa. Therefore, the data signal S(i) from each buffer 31 is outputted from the source driver 300 through a corresponding first MOS transistor SWa (i=1, 2, . . . , N).

The output part 304 includes a precharge power supply 35 that alternately outputs a positive-polarity precharge voltage VprP and a negative-polarity precharge voltage VprN at a predetermined cycle based on the second polarity reversal control signal Rev2; and a polarity reversing circuit 34 that reverses the polarity of a voltage outputted from the precharge power supply 35. The precharge power supply 35 and the polarity reversing circuit 34 constitute a precharge signal generating circuit that generates signals Spr1 and Spr2 for precharge. By such a configuration, a precharge circuit reverses the polarity of a precharge voltage to be provided to each source line SLi in response to the polarity reversal of the data signal S(i). Here, both of the positive-polarity precharge voltage VprP and the negative-polarity precharge voltage VprN have such a value that can be considered as a voltage of the data signal S(i) corresponding to black display in a normally black-type liquid crystal display apparatus such as that in the present embodiment.

A voltage outputted from the polarity reversing circuit 34 is used, as a first precharge signal Spr1, for precharge (preliminary charge) on odd-numbered source lines $SLi_{od}$ ($i_{od}$=1, 3, 5, . . . ) and a voltage outputted from the precharge power supply 35 is used, as a second precharge signal Spr2, for precharge on even-numbered source lines $SLi_{ev}$ ($i_{ev}$=2, 4, 6, . . . ). Specifically, of the output terminals of the source driver 300, to each of odd-numbered output terminals to which the odd-numbered source lines $SLi_{od}$ are to be connected is provided a second MOS transistor SWb serving as a switching element. Each of the odd-numbered output terminals is connected to an output terminal of the polarity reversing circuit 34 through the corresponding second MOS transistor SWb. On the other hand, of the output terminals of the source driver 300, to each of even-numbered output terminals to which the even-numbered source lines $SLi_{ev}$ are to be connected is provided a third MOS transistor SWc serving as a switching element. Each of the even-numbered output terminals is connected to an output terminal of the precharge power supply 35 through the corresponding third MOS transistor SWc.

The output part 304 has an inverter 33. By the inverter 33, a logical inverse signal of the precharge control signal Cpr outputted from the display control circuit 200 is generated. The precharge control signal Cpr is provided to gate terminals of the second and third MOS transistors SWb and SWc and the logical inverse signal of the precharge control signal Cpr is provided to gate terminals of the first MOS transistors SWa. Note that each of the first, second, and third MOS transistors SWa, SWb, and SWc is turned on when a high-level (H level) signal is provided to their respective gate terminals and is turned off when a low-level (L level) signal is provided.

Figure 4:
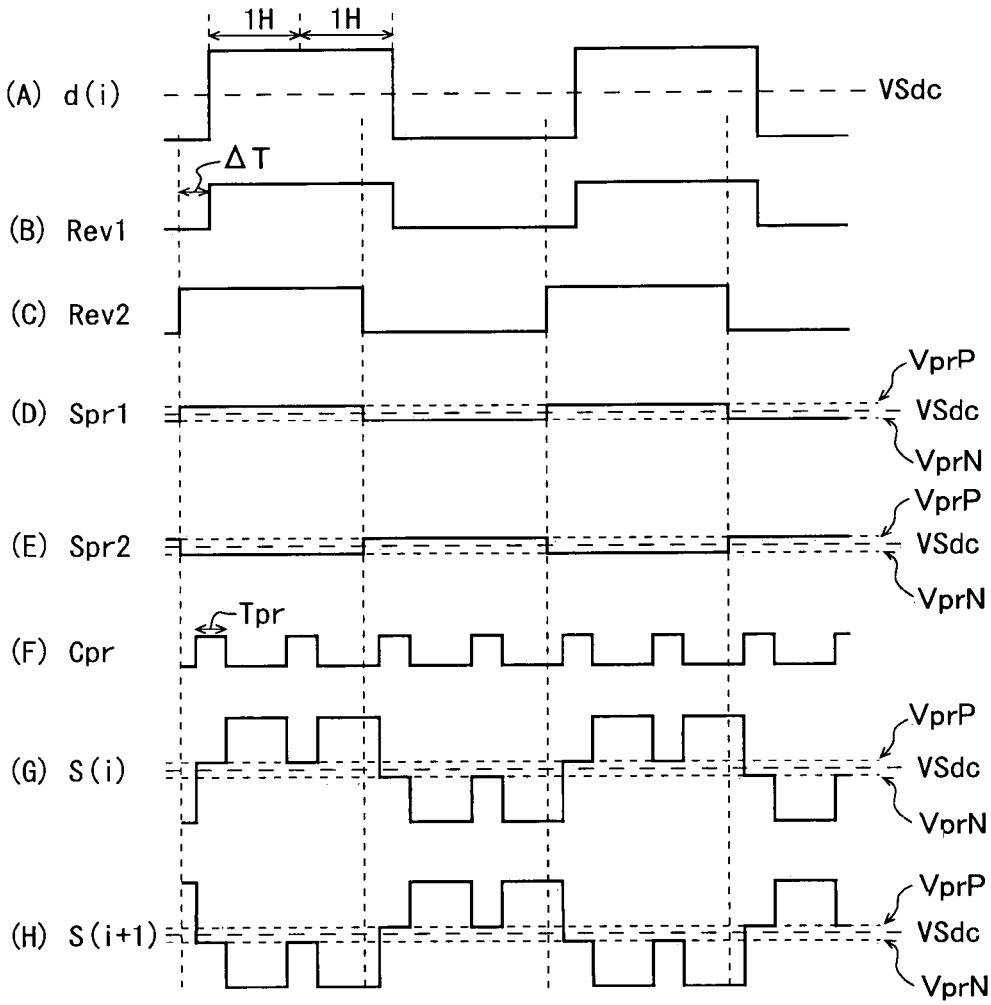
FIG. 4 consists of signal waveform diagrams (A) to (H) for describing the operation of the source driver in the embodiment.

With reference to FIG. 4, the operation of the source driver 300 having a configuration as described above will be described below. As shown in (A) and (B) of FIG. 4, the internal data signal d(i) outputted from the data signal generation part 302 of the source driver 300 is generated as an analog voltage signal whose polarity is reversed every two horizontal periods, based on the first polarity reversal control signal Rev1, with reference to a source center potential VSdc (direct-current level of the data signal S(i)) (in the drawing, "1H" represents one horizontal period).

As shown in (C), (D), and (E) of FIG. 4, the first precharge signal Spr1 is a voltage signal whose polarity is reversed based on the second polarity reversal control signal Rev2, with reference to the source center potential VSdc, i.e., a voltage signal in which the positive-polarity precharge voltage VprP and the negative-polarity precharge voltage VprN alternately appear every two horizontal periods. As shown in (E) of FIG. 4, the second precharge signal Spr2 is a voltage signal obtained by reversing the polarity of the first precharge signal Spr1. Here, the timing of the second polarity reversal control signal Rev2 is slightly shifted from that of the first polarity reversal control signal Rev1 so as to rise earlier than the precharge control signal Cpr (FIG. 4 depicts that the second polarity reversal control signal Rev2 rises earlier than the first polarity reversal control signal Rev1 by ΔT. The ΔT may be, for example, a time corresponding to the order of 10 clocks of the data clock signal SCK).

The polarities of the first and second precharge signals Spr1 and Spr2 are set to match the polarity of a data signal S(i) to be provided to a source line SLi during an effective scanning period that is immediately after a precharge period Tpr during which the signal Spr1 or Spr2 is provided to the source line SLi. Specifically, the precharge power supply 35 is configured such that the polarity of the second precharge signal Spr2 is the same as the polarity of data signals $S(i_{ev})$ provided to the even-numbered source lines $SLi_{ev}$ during an effective scanning period (note, however, that a period of ΔT corresponding to the above-described timing shift is excluded). Since in the present embodiment the dot inversion drive scheme is adopted, the polarity of the first precharge signal Spr1 is the same as the polarity of data signals $S(i_{od})$ provided to the odd-numbered source lines $SLi_{od}$ during an effective scanning period (note, however, that a period of ΔT corresponding to the above-described timing shift is excluded). In this manner, the polarity of the first or second precharge signal Spr1 or Spr2 provided to each source line SLi during each precharge period Tpr matches the polarity of a data signal S(i) provided to the source line SLi immediately after the precharge period.

The precharge control signal Cpr is a signal for determining a precharge period Tpr. As shown in (F) of FIG. 4, the precharge control signal Cpr goes into an H level every horizontal period and a period of the H level is a precharge period. The precharge period Tpr is set such that pixel data of an image to be displayed is not written to any of the pixel formation portions during the period Tpr. Specifically, the precharge period Tpr is set so as not to overlap with any of periods of a pixel data write pulse Pw (pixel data write periods) which will be described later. For such a precharge period Tpr, a horizontal blanking period or a predetermined period included therein may be set. The reason that the precharge period Tpr is thus set so as not to overlap with any of the pixel data write periods is to prevent write of pixel data of an image to be displayed from being adversely affected by application of a precharge voltage to each source line SLi.

As previously described, the precharge control signal Cpr is provided to the gate terminals of the second and third MOS transistors SWb and SWc in the output part 304 of the source driver 300 and a logical inverse signal of the precharge control signal Cpr is provided to the gate terminals of the first MOS transistors SWa in the output part 304 (see FIG. 3). Therefore, during the precharge period Tpr, the first precharge signal Spr1 is provided to the odd-numbered source lines $SLi_{od}$ and the second precharge signal Spr2 is provided to the even-numbered source lines $SLi_{ev}$. During an effective scanning period which is a period other than the precharge period Tpr, the internal data signal d(i) is provided to each source line SLi as a data signal S(i). That is, given that i is an odd number, a voltage of a waveform as shown in (G) of FIG. 4 is provided to the odd-numbered source lines SLi as a data signal S(i) and a voltage of a waveform as shown in (H) of FIG. 4 is provided to the even-numbered source lines Sli+1 as a data signal S(i+1).

1.3 Gate Driver

The gate driver 400 sequentially selects, based on the gate start pulse signal GSP, the gate clock signal GCK, and the gate driver output control signal GOEr (r=1, 2, . . . , q), the gate lines GL1 to GLM substantially every horizontal period (effective scanning period) in each frame period of the digital image signal DA, so as to write the data signals S(1) to S(N) in (the pixel capacitances Cp of) the respective pixel formation portions, and also selects a gate line GLj during a precharge period Tpr selected in advance for each scanning signal line GLj among precharge periods Tpr of every horizontal period, so as to perform black insertion which will be described later (j=1 to M).

Figure 5:
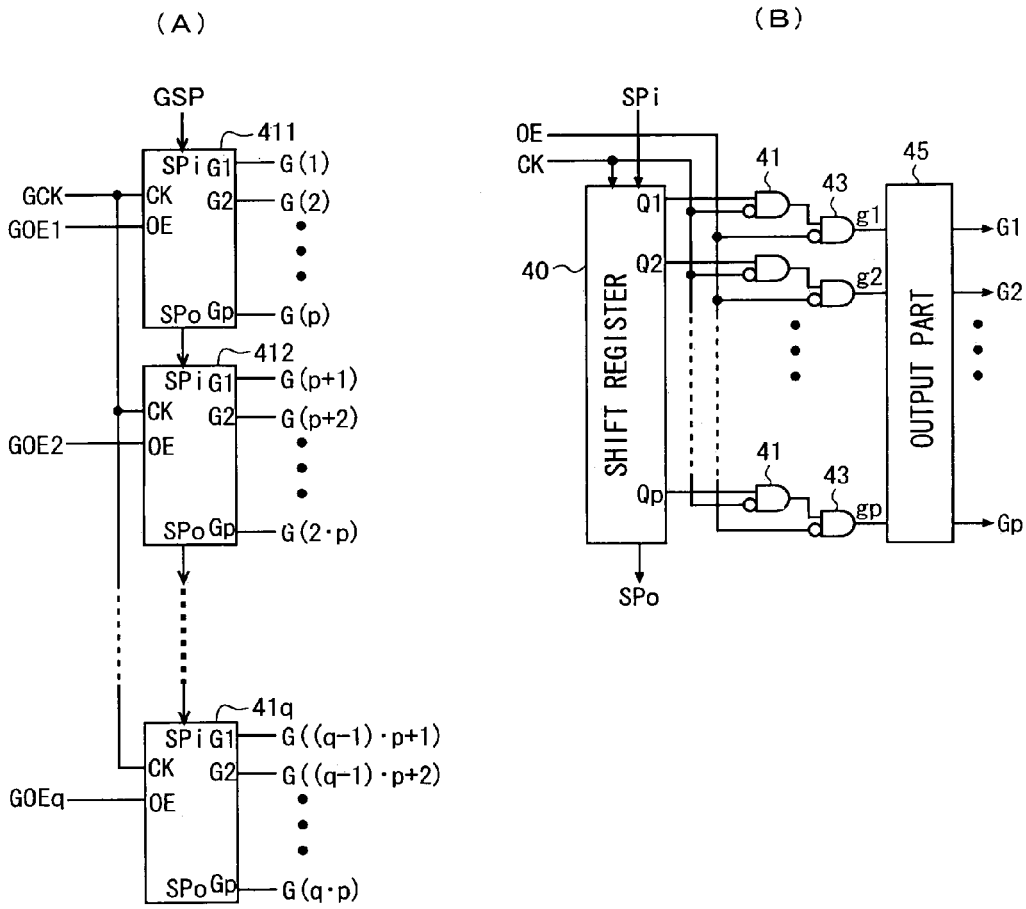
FIG. 5 consists of block diagrams (A) and (B) showing an exemplary configuration of a gate driver in the embodiment.

(A) and (B) of FIG. 5 are block diagrams showing an exemplary configuration of the gate driver 400. The gate driver 400 of the exemplary configuration is composed of a plurality of (q) gate driver IC (Integrated Circuit) chips 411, 412, . . . , 41*q* each including a shift register and serving as a partial circuit.

As shown in (B) of FIG. 5, each gate driver IC chip includes a shift register 40, first and second AND gates 41 and 43 provided for each stage of the shift register 40, and an output part 45 that outputs scanning signals G1 to Gp based on output signals g1 to gp from the second AND gates 43, and receives a start pulse signal SPi, a clock signal CK, and an output control signal OE from an external source. The start pulse signal SPi is provided to an input terminal of the shift register 40, and a start pulse signal SPo to be inputted to a subsequent gate driver IC chip is outputted from an output terminal of the shift register 40. To each of the first AND gates 41 is inputted a logical inverse signal of the clock signal CK, and to each of the second AND gates 43 is inputted a logical inverse signal of the output control signal OE. An output signal Qk (k=1 to p) from each stage of the shift register 40 is inputted to a first AND gate 41 corresponding to the stage and an output signal from the first AND gate 41 is inputted to a second AND gate 43 corresponding to the stage.

As shown in (A) of FIG. 5, the gate driver 400 of the exemplary configuration is implemented by the plurality of (q) gate driver IC chips 411 to 41*q* of the above-described configuration being cascade-connected to one another. Specifically, an output terminal (output terminal for a start pulse signal SPo) of a shift register in each gate driver IC chip is connected to an input terminal (input terminal for a start pulse signal SPi), of a shift register in its subsequent gate driver IC chip such that the shift registers 40 in the gate driver IC chips 411 to 41*q* form one shift register (the shift registers thus formed by cascade connection are hereinafter referred to as "coupled shift registers"). Note, however, that to an input terminal of a shift register in the first gate driver IC chip 411 is inputted the gate start pulse signal GSP from the display control circuit 200, and an output terminal of a shift register in the last gate driver IC chip 41*q* is not connected to an external source. The gate clock signal GCK from the display control circuit 200 is inputted in common to each of the gate driver IC chips 411 to 41*q* as the clock signal CK. On the other hand, the gate driver output control signals GOE generated by the display control circuit 200 include first to qth gate driver output control signals GOE1 to GOEq. The gate driver output control signals GOE1 to GOEq are individually inputted respectively to the gate driver IC chips 411 to 41*q* as the output control signals OE.

Figure 6:
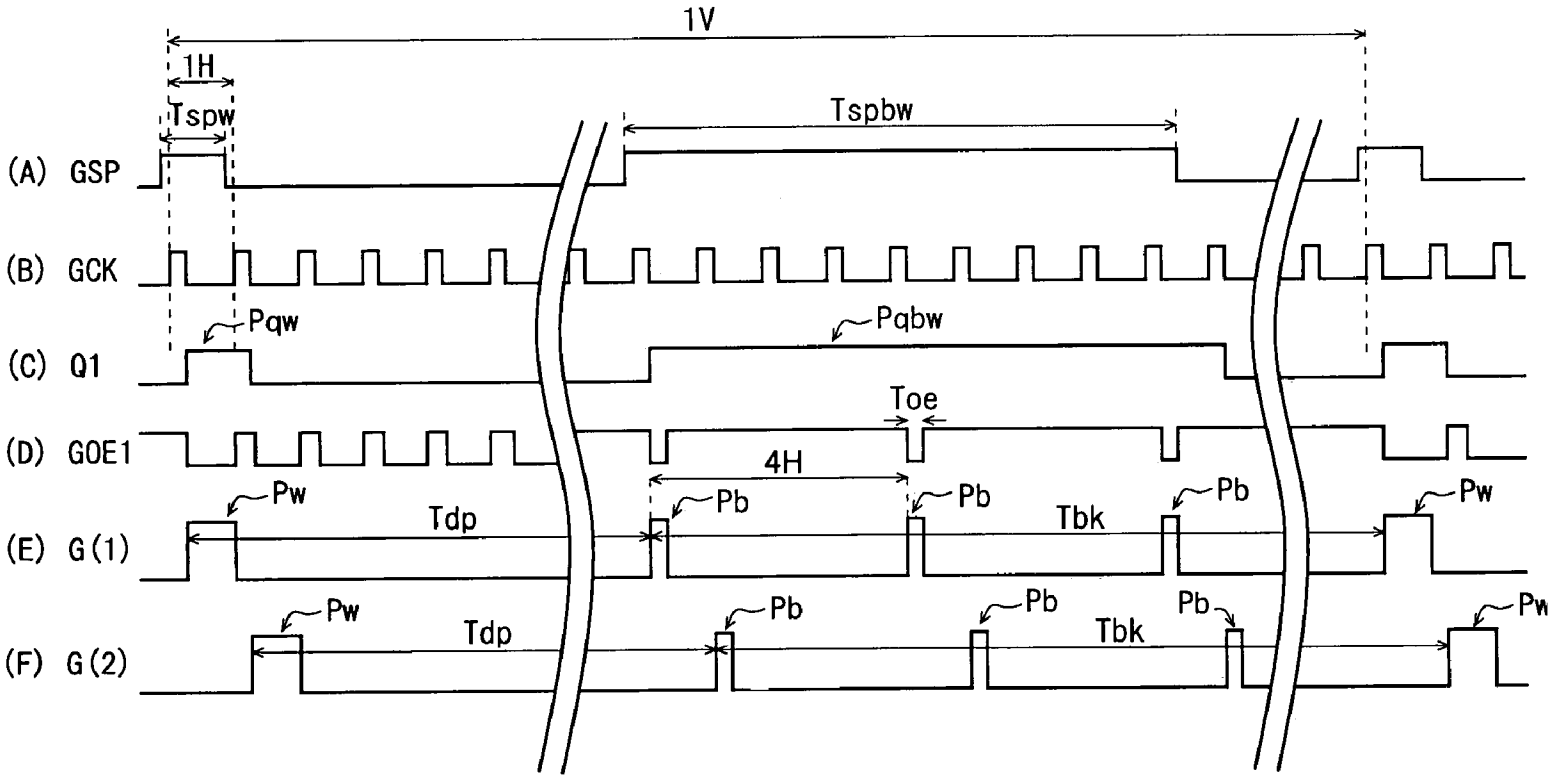
FIG. 6 consists of signal waveform diagrams (A) to (F) for describing the operation of the gate driver in the embodiment.

Next, with reference to FIG. 6, the operation of the gate driver 400 according to the above-described exemplary configuration will be described. As shown in (A) of FIG. 6, the display control circuit 200 generates, as a gate start pulse signal GSP, a signal that is at an H level (active) during a period Tspw corresponding to a pixel data write pulse Pw and a period Tspbw corresponding to three black voltage application pulses Pb and generates, as shown in (B) of FIG. 6, a gate clock signal GCK that is at an H level during a predetermined period, every horizontal period (1H). When such a gate start pulse signal GSP and a gate clock signal GCK are inputted to the gate driver 400 in FIG. 5, a signal as shown in (C) of FIG. 6 is outputted as an output signal Q1 from the first stage of the shift register 40 of the first gate driver IC chip 411. The output signal Q1 includes, in each frame period, one pulse Pqw corresponding to a pixel data write pulse Pw and one pulse Pqbw corresponding to three black voltage application pulses Pb and the two pulses Pqw and Pqbw are spaced apart by substantially an image display period Tdp. Such two pulses Pqw and Pqbw are sequentially transferred through the coupled shift registers in the gate driver 400, according to the gate clock signal GCK. In accordance with that, a signal having a waveform as shown in (C) of FIG. 6 is sequentially outputted from each stage of the coupled shift registers so as to be shifted by one horizontal scanning period (1H).

Also, the display control circuit 200 generates, as previously described, the gate driver output control signals GOE1 to GOEq to be provided to the gate driver IC chips 411 to 41*q* composing the gate driver 400. Here, the gate driver output control signal GOEr to be provided to an rth gate driver IC chip 41*r* is at an L level during a period where a pulse Pqw corresponding to a pixel data write pulse Pw is outputted from any one of the stages of a shift register 40 in the gate driver IC chip 41*r*, except that the gate driver output control signal GOEr goes to an H level during a predetermined period near a pulse of the gate clock signal GCK for adjustment of the pixel data write pulse Pw, and during other periods the gate driver output control signal GOEr is at an H level except that the gate driver output control signal GOEr is at an L level during a predetermined period Toe that is immediately after the gate clock signal GCK is changed from an H level to an L level. Note, however, that the predetermined period Toe is set so as to be included in any of precharge periods Tpr. For example, a gate driver output control signal GOE1 as shown in (D) of FIG. 6 is provided to the first gate driver IC chip 411. Note that a pulse that is included in the gate driver output control signals GOE1 to GOEq for adjustment of a pixel data write pulse Pw (which corresponds to going into an H level during the above-described predetermined period and which is hereinafter referred to as a "write period adjustment pulse") rises earlier than the rise of the gate clock signal GCK or falls later than the fall of the gate clock signal GCK, according to a necessary pixel data write pulse Pw. Note also that without using such a write period adjustment pulse, only by a pulse of the gate clock signal GCK, a pixel data write pulse Pw may be adjusted.

In each gate driver IC chip 41*r* (r=1 to q), based on the output signal Qk (k=1 to p) from each stage of a shift register 40, the gate clock signal GCK, and the gate driver output control signal GOEr, as described above, internal scanning signals g1 to gp are generated by the first and second AND gates 41 and 43 and the internal scanning signals g1 to gp are level-converted by the output part 45, whereby scanning signals G1 to Gp to be applied to the gate lines are outputted. Accordingly, as shown in (E) and (F) of FIG. 6, a pixel data write pulse Pw is sequentially applied to the gate lines GL1 to GLM, and in each gate line GLj (j=1 to M) a black voltage application pulse Pb is applied at a point in time at which an image display period Tdp has elapsed since the start of application of the pixel data write pulse Pw, and thereafter, two black voltage application pulses Pb are applied at intervals of four horizontal periods (4H). After the three black voltage application pulses Pb are thus applied, an L level is maintained until a pixel data write pulse Pw for a next frame period is applied. That is, during a period from the start of application of the black voltage application pulse Pb until a next pixel data write pulse Pw is applied, a black display period Tbk exists.

Figure 7:
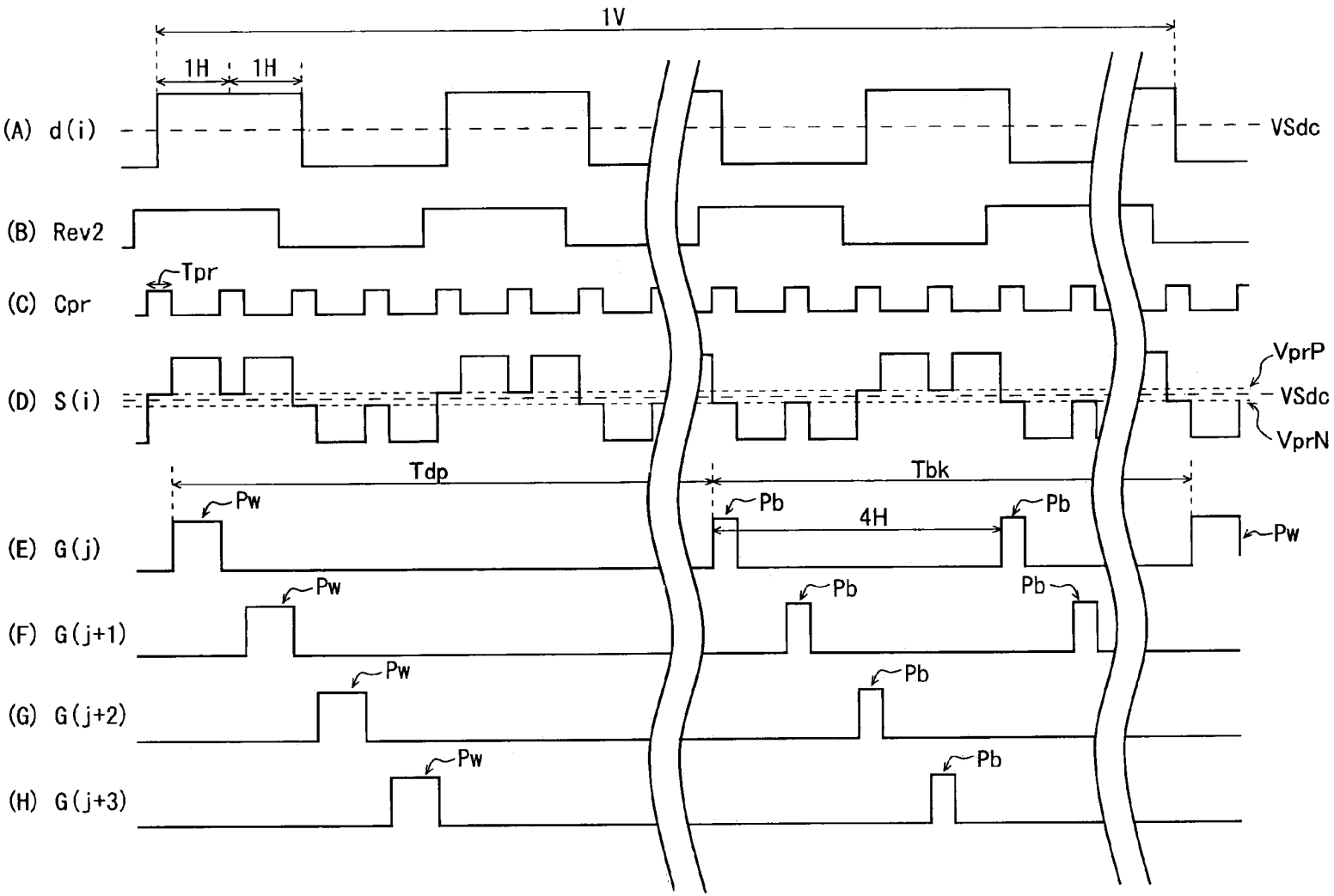
FIG. 7 consists of signal waveform diagrams (A) to (H) for describing a driving method for the liquid crystal display apparatus according to the embodiment.

In the above-described manner, by the gate driver 400 of the configuration shown in (A) and (B) of FIG. 5, impulse drive can be implemented in the liquid crystal display apparatus, as shown in (D) to (H) of FIG. 7.

Specifically, the gate driver 400 applies the scanning signals G(1) to G(M) including the pixel data write pulses Pw and black voltage application pulses Pb, such as those shown in (E) to (H) of FIG. 7, respectively to the gate lines GL1 to GLM. A gate line GLj to which the pulses Pw and Pb are applied is in a selected state and TFTs 10 connected to the gate line GLj being in the selected state are in an on state (TFTs 10 connected to a gate line being in a non-selected state are in an off state). Here, the pixel data write pulse Pw is at an H level during an effective scanning period corresponding to a display period in one horizontal period (1H); on the other hand, the black voltage application pulse Pb is at an H level during a precharge period Tpr corresponding to a blanking period or a predetermined period included therein, in a horizontal period. In the present embodiment, as shown in (E) to (H) of FIG. 7, in each scanning signal G(j), the length of a period from when a pixel data write pulse Pw appears until a black voltage application pulse Pb first appears, i.e., an image display period Tdp, is a ⅔ frame period, and a plurality of (three in the present embodiment) black voltage application pulses Pb successively appear at intervals of four horizontal periods (4H) in one frame period (1V). Therefore, during a period (black display period) Tbk from when the black voltage application pulses Pb appears until a pixel data write pulse Pw for a next frame appears, black display is performed. Note, however, that when black display cannot be securely achieved only with one black voltage application pulse Pb, a period during which black display is actually obtained is slightly shorter than the black display period Tbk.

In each scanning signal G(j), black voltage application pulses Pb in one frame period from when a pixel data write pulse Pw in a certain frame appears until a pixel data write pulse Pw next appears, appear when a precharge voltage of opposite polarity to that of a data signal S(i) representing pixel data written by the pixel data write pulse Pw in the frame period is being provided to a source line SLi. For example, in a scanning signal G(j) shown in (E) of FIG. 7, since the first pixel data write pulse Pw appears when a positive-polarity data signal S(i) is provided to a source line SLi, after that, before a pixel data write pulse Pw next appears, black voltage application pulses Pb (three black voltage application pulses Pb at intervals of four horizontal periods) appear when the negative-polarity precharge voltage VprN is being provided to the source line SLi. Also, for example, in a scanning signal G(j+2) shown in (G) of FIG. 7, since the first pixel data write pulse Pw appears when a negative-polarity data signal S(i) is being provided to a source line SLi, after that, before a pixel data write pulse Pw next appears, black voltage application pulses Pb (three black voltage application pulses Pb at intervals of four horizontal periods) appear when the positive-polarity precharge voltage VprP is being provided to the source line SLi.

1.4 Driving Method

Next, with reference to FIG. 7, a driving method for the liquid crystal display apparatus according to the present embodiment, i.e., a driving method for the display part 100 (see FIG. 1) by the source driver 300 and the gate driver 400, will be described. (A) to (D) of FIG. 7 show waveforms of the internal data signal d(i), the second polarity reversal control signal Rev2, the precharge control signal Cpr, and the data signal S(i) for when the source driver 300 shown in FIGS. 2 and 3 is used (see FIG. 4). (E) to (H) of FIG. 7 show waveforms of scanning signals G(j) to G(j+3) outputted from the gate driver 400 in the above-described manner.

Now, taking a look at a pixel formation portion in a kth row and an ith column in a pixel array on the display part 100, given that the pixel formation portion is represented by the symbol "P(k,i)", in the pixel formation portion P(k,i), when a pixel data write pulse Pw is applied to a kth gate line GLk, a TFT therein is turned on and a data signal S(i) on a source line SLi is written to the pixel formation portion P(k,i) as pixel data. That is, the voltage of the source line SLi is held in a pixel capacitance Cp of the pixel formation portion P(k,i). Thereafter, the gate line GLk is in a non-selected state until a black voltage application pulse Pb appears, and thus, the pixel data written to the pixel formation portion P(k,i), i.e., the voltage in the pixel capacitance Cp, is held as it is.

During a precharge period Tpr after the lapse of an image display period Tdp from when a pixel data write pulse Pw appears in a scanning signal GL(k) on the gate line GLk, a black voltage application pulse Pb is applied to the gate line GLk. As previously described, during the precharge period Tpr, a precharge voltage of opposite polarity to that of the data signal S(i) provided to the pixel formation portion P(k,i) as pixel data by the pixel data write pulse Pw is provided to the source line SLi. Specifically, referring to the scanning signals G(j) to G(j+3) shown in (E) to (H) of FIG. 7, when k=j or k=j+1 the negative-polarity precharge voltage VprN is provided to the source line SLi, and when k=j+2 or k=j+3 the positive-polarity precharge voltage VprP is provided to the source line SLi. In the present embodiment, the positive-polarity and negative-polarity precharge voltages VprP and VprN have relatively small absolute values (i.e., values close to the source center potential VSdc) and thus can be considered as voltages corresponding to black display (hereinafter, referred to as "black voltages"). Therefore, by application of a black voltage application pulse Pb to the gate line GLk, the voltage held in the pixel capacitance Cp of the pixel formation portion P(k,i) changes toward the black voltage. However, since the pulse width of the black voltage application pulse Pb is narrow, in order to securely bring the holding voltage in the pixel capacitance Cp to the black voltage, in each frame period, three black voltage application pulses Pb are successively applied to the gate line GLk at intervals of four horizontal periods (4H). Accordingly, the luminance of a pixel formed by the pixel formation portion P(k,i) connected to the gate line GLk (the amount of transmission of light through the liquid crystal layer which is determined by the holding voltage in the pixel capacitance Cp) becomes a low luminance corresponding to black display.

Hence, in one display line composed of pixel formation portions connected to each gate line GLj (j=1 to M), during an image display period Tdp, display based on the digital image signal DA is performed, and during a period Tbk from when, after the display, black voltage application pulses Pb appear in the gate line GLj until a pixel data write pulse Pw next appears, black display is performed. In this manner, by a black display period Tbk being inserted in each frame period, impulse display by the liquid crystal display apparatus is implemented.

Since the polarity of a data signal S(i) representing pixel data to be written to each pixel formation portion is reversed every frame period, by the temporal location of black voltage application pulses Pb being set in the above-described manner ((D) to (H) of FIG. 7), the polarity of a precharge voltage to be provided to each source line SLi during a period of the black voltage application pulses Pb is the same as that of a data signal S(i) to be provided to the source line SLi during a period of a next pixel data write pulse Pw. Therefore, black insertion in the present embodiment indicates that a precharge voltage (VprP or VprN) of the same polarity as that of a data signal S(i) representing pixel data to be written next to each pixel formation portion is provided to a pixel capacitance Cp (more precisely, a pixel electrode forming the pixel capacitance Cp), and thus the black insertion (application of a black voltage) also serves as precharge on the pixel capacitance Cp. Accordingly, in the present embodiment, by black insertion, the charge rate of pixel capacitances Cp can be improved.

Note that since in the present embodiment a 2H dot inversion drive scheme is adopted, during one black display period Tbk, black voltage application pulses Pb are applied to each gate line GLi at intervals of four horizontal periods (4H). Generally, in the case in which an nH dot inversion drive scheme (n is a natural number) is adopted, when a plurality of black voltage application pulses Pb are applied to each gate line GLi during one black display period Tbk, black voltage application pulses Pb should be applied at intervals of 2n horizontal periods (2nH). In such a manner, by causing the polarity of a precharge voltage during a period of black voltage application pulses Pb to match the polarity of a data signal S(i) during a period of a next pixel data write pulse Pw, precharge on a pixel capacitance Cp is enabled.

Meanwhile, in conventional liquid crystal display apparatuses that adopt a 2H dot inversion drive scheme, as in the present embodiment, a difference may occur in the amount of charge on a pixel capacitance between the first and second ones of two display lines which are the unit of polarity reversal and the difference may appear as a luminance difference; accordingly, line-like transverse unevenness may be visually identified. In the present embodiment, however, as shown in (D) of FIG. 7, a precharge period Tpr is provided every horizontal period so that a precharge voltage (VprP or VprN) of the same polarity is provided during a precharge period Tpr that is immediately before each of the effective scanning periods of two display lines which are the unit of polarity reversal. Accordingly, the charge condition of a pixel capacitance Cp is uniformed between two display lines which are the unit of polarity reversal, enabling to prevent occurrence of transverse unevenness caused by a difference in the amount of charge, such as that described above.

Next, with reference to FIG. 8, the charge operation of pixel capacitances Cp in the present embodiment will be described in detail.

Now, taking a look at a voltage (hereinafter, referred to as a "source line voltage") Vs of an ith (i is any of 1 to N) source line SLi, it is assumed that at time t1, the polarity of a data signal S(i) applied to the source line SLi is reversed from negative polarity to positive polarity with reference to the source center potential VSdc. Times t1 to t2 are a precharge period Tpr and during the precharge period Tpr the positive-polarity precharge voltage VprP is provided to the source line SLi. Thus, the source line voltage Vs rises from a negative voltage and becomes equal to the positive-polarity precharge voltage VprP at time t2.

During times t2 to t4, instead of the precharge voltage VprP, a positive voltage (voltage indicated by an internal data signal d(i)) Vs1 indicating a value of a pixel to be displayed is provided to the source line SLi as a data signal S(i) (see FIG. 3). The positive voltage Vs1 is a voltage indicating an ith pixel value in a jth display line. After time t2, the source line voltage Vs rises toward the positive voltage Vs1. At time t2, a scanning signal G(j) changes from non-active (L level) to active (H level) and is in an active state during times t2 to t3 (corresponding to an effective scanning period). This indicates that during a period of times t2 to t3, a pixel data write pulse Pw is applied to a gate line GLj. Accordingly, a TFT 10 of a pixel formation portion P(j,i) connected to the gate line GLj goes into an on state and a pixel capacitance Cp of the pixel formation portion P(j,i) is charged through the TFT 10.

As previously described, since the pixel capacitance Cp is precharged by a black voltage application pulse Pb which is applied to the gate line GLj prior to the application of the pixel data write pulse Pw during times t2 to t3, at time t2 a voltage of a pixel electrode (hereinafter, referred to as a "pixel voltage") Vp of the pixel formation portion P(j,i) is substantially equal to the positive-polarity precharge voltage VprP. Hence, after time t2, the pixel voltage Vp rises along with the rise of the source line voltage Vs, as shown by a dashed line in (B) of FIG. 8. Thereafter, at time t3, the scanning signal G(j) changes from active to non-active but the source line voltage Vs is maintained until time t4 (point in time of the start of a next precharge period Tpr) and the pixel voltage Vp of the pixel formation portion P(j,i) is maintained until a black voltage application pulse Pb is applied to the gate line GLj (see (E) of FIG. 7).

Thereafter, during a precharge period Tpr at times t4 to t5, the positive-polarity precharge voltage VprP is provided again to the source line SLi. Accordingly, the source line voltage Vs drops from the positive voltage Vs1 indicating the pixel value and becomes equal to the positive-polarity precharge voltage VprP at time t5.

During times t5 to t7, instead of the precharge voltage VprP, a positive voltage Vs2 indicating a value of a pixel to be displayed is provided to the source line SLi as the data signal S(i). The positive voltage Vs2 is a voltage indicating an ith pixel value in a j+1th display line. After time t5, the source line voltage Vs rises toward the positive voltage Vs2. At time t5, a scanning signal G(j+1) changes from non-active to active and is in an active state during times t5 to t6 (corresponding to an effective scanning period). This indicates that during a period of times t5 to t6, a pixel data write pulse Pw is applied to a gate line GLj+1. Accordingly, a TFT 10 of a pixel formation portion P(j+1, i) connected to the gate line GLj+1 is in an on state and a pixel capacitance Cp of the pixel formation portion P(j+1, i) is charged through the TFT 10.

Since the pixel capacitance Cp is also precharged by a black voltage application pulse Pb which is applied to the gate line GLj+1 prior to the application of the pixel data write pulse Pw during times t5 to t6, at time t5 a pixel voltage Vp of the pixel formation portion P(j+1, i) is substantially equal to the positive-polarity precharge voltage VprP. Hence, after time t5, the pixel voltage Vp rises along with the rise of the source line voltage Vs, as shown by a dashed line in (B) of FIG. 8. Thereafter, at time t6, the scanning signal G(j+1) changes from active to non-active but the source line voltage Vs is maintained until time t7 (point in time of the start of a next precharge period Tpr) and the pixel voltage Vp of the pixel formation portion (j+1, i) is maintained until a black voltage application pulse Pb is applied to the gate line GLj+1.

Thereafter, during a precharge period Tpr at times t7 to t8, the negative-polarity precharge voltage VprN is provided to the source line SLi. Accordingly, the source line voltage Vs drops from the positive voltage Vs2 indicating the pixel value and becomes equal to the negative-polarity precharge voltage VprN at time t8. Then, in a period of times t8 to t10, during two effective scanning periods respectively for two display lines, negative voltages Vs3 and Vs4 which are voltages indicating values of pixels to be displayed are provided to the source line SLi, and during a precharge period Tpr the negative-polarity voltage VprN is provided to the source line SLi as a precharge voltage. Hence, a charge operation performed on pixel capacitances Cp (in j+2th and j+3th display lines) during times t7 to t10 is the same as that performed on pixel capacitances Cp (in jth and j+1th display lines) during times t1 to t7, except that there are differences in the polarity and change direction of a voltage.

Figure 8:
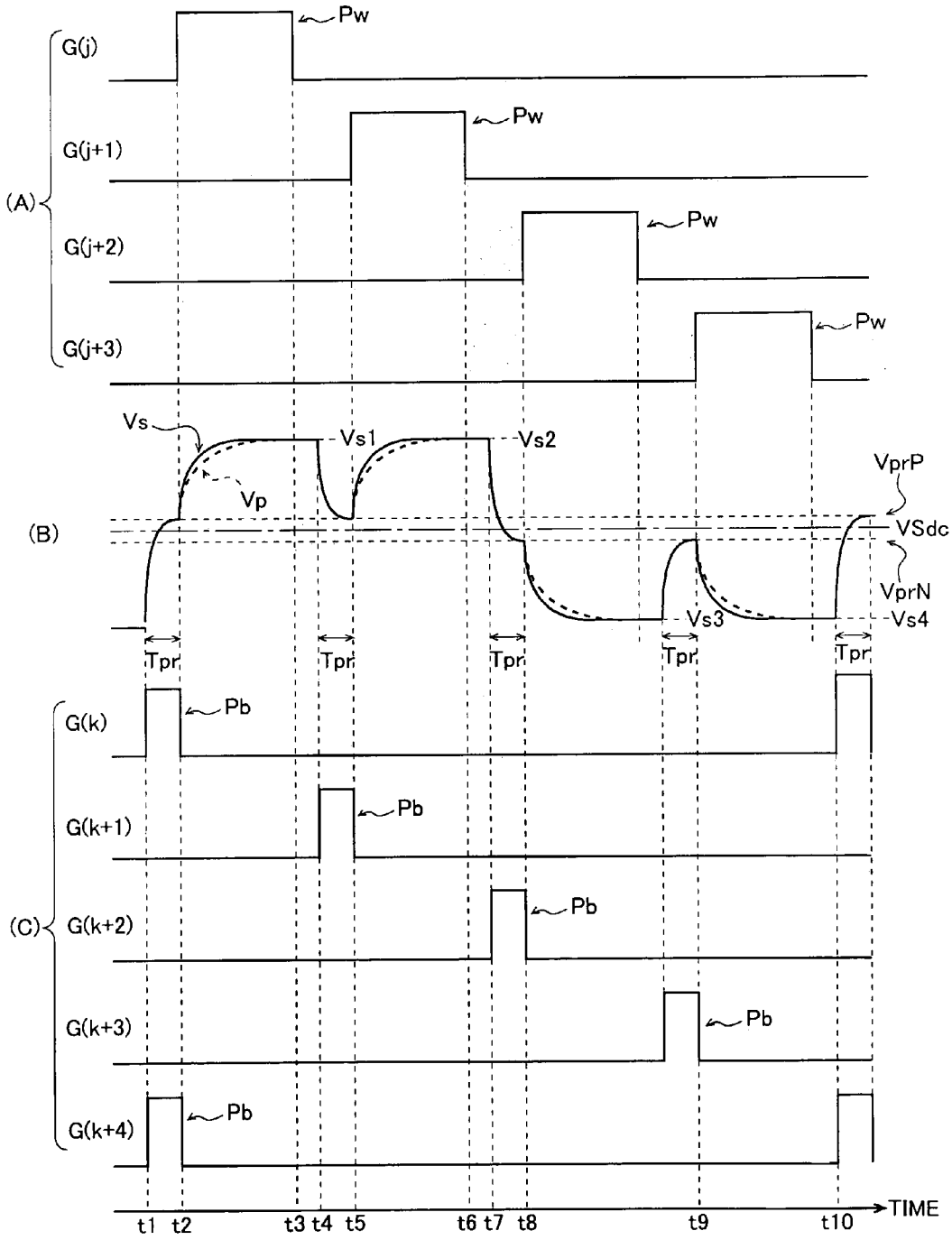
FIG. 8 consists of detailed signal waveform diagrams (A) to (C) for describing a charge operation of pixel capacitances in the embodiment.

Note that when a pixel data write pulse Pw is applied to gate lines GLk and GLk+1 for the first time after black voltage application pulses Pb of scanning signals G(k) and G(k+1) shown in (C) of FIG. 8, a positive-polarity data signal S(i) is provided to each source line SLi. On the other hand, when a pixel data write pulse Pw is applied to gate lines GLk+2 and GLk+3 for the first time after black voltage application pulses Pb of scanning signals G(k+2) and G(k+3) shown in (C) of FIG. 8, a negative-polarity data signal S(i) is provided to each source line SLi. In accordance with this, when the black voltage application pulses Pb of the scanning signal G(k) and G(k+1) shown in (C) of FIG. 8 are applied to gate lines GLk, GLk+1, the positive-polarity precharge voltage VprP is provided to each source line SLi and when the black voltage application pulses Pb of the scanning signals G(k+2) and G(k+3) shown in (C) of FIG. 8 are applied to the gate lines GLk+2 and GLk+3, the negative-polarity precharge voltage VprN is provided to each source line SLi (see FIG. 7). As previously described, by such a configuration, precharge on each pixel capacitance Cp is implemented.

1.5 Specific Example

In the present embodiment as described above, the degree of an improvement in the charge rate of a pixel capacitance and the uniformity of a charge condition by precharge on a pixel capacitance Cp and a source line SLi is dependent on the width of a black voltage application pulse Pb (hereinafter, abbreviated as the "Pb width"), the length of a period (hereinafter, referred to as a "data signal period") during which data signals S(1) to S(N) representing an image to be displayed are applied to the source lines SL1 to SLN, and the length of a precharge period Tpr. In view of this, appropriate exemplary numerical values of the Pb width and the lengths of the data signal period and the precharge period are shown in the following table. The table shows specific numerical values for three models of liquid crystal display apparatuses having different screen sizes that are used in a high-definition television (HDTV) with 1080 scanning lines, i.e., a full high-vision (1080×1920×RGB dots), television receiver. Note that the numerical values in the table indicate the application time of a signal to a source line SLi serving as a data signal line or a gate line GLj serving as a scanning signal line, and each scanning signal G(j) includes four black voltage application pulses in one frame period.

TABLE 1

| Model | Pb width | Data signal period | Precharge period |
|---|---|---|---|
| 37" | 1.2 micro-seconds | 11.2 micro-seconds | 3.6 micro-seconds |
| 46" | 1.6 micro-seconds | 10.8 micro-seconds | 4.0 micro-seconds |
| 52" | 1.8 micro-seconds | 10.6 micro-seconds | 4.2 micro-seconds |

Note that the numerical values of the Pb width and the lengths of the data signal period and the precharge period shown in the above table do not limit the present invention. These specific numerical values should be determined taking into account the definition, screen size, etc., of a liquid crystal display apparatus upon implementation of the present invention.

1.6 Effects

According to the present embodiment as described above, as shown in (D) to (H) of FIG. 7, the precharge period Tpr is provided every horizontal period, the precharge voltage (VprP or VprN) corresponding to a black voltage is provided to each source line SLi during the precharge period Tpr, and black voltage application pulses Pb are applied to each gate line GLj during a period from when a pixel data write pulse Pw is applied until a pixel data write pulse Pw is next applied. Accordingly, impulse display on the liquid crystal display apparatus is implemented, enabling to improve the display performance of a moving image. Note that in the implementation of impulse, without reducing the charge period of a pixel capacitance Cp for pixel data write, a sufficient black insertion period is secured. Moreover, the operating speed of the source driver 300, etc. does not need to be increased for black insertion.

According to the present embodiment, as shown in (D) and (E) of FIG. 7, when taking a look at one source line SLi, the polarity of a precharge voltage at a time when a black voltage application pulse Pb is applied to each gate line GLj is the same as that of a data signal S(i) at a time when a pixel data write pulse Pw is applied next to the gate line GLj. Accordingly, black insertion by the black voltage application pulse Pb (specifically, application of the positive-polarity or negative-polarity precharge voltage VprP or VprN to a pixel electrode) also serves as precharge on a pixel capacitance Cp, and thus, the charge rate of the pixel capacitance Cp can be improved.

According to the present embodiment, as shown in (D) to (H) of FIG. 4 and (B) of FIG. 8, during a precharge period Tpr at the time of polarity reversal of a data signal S(i) applied to each source line SLi, the precharge voltage (VprP or VprN) of the same polarity as that of the data signal S(i) provided immediately after the precharge period Tpr is provided to each source line SLi. By such precharge on the source lines SLi, the charge rate of a pixel capacitance Cp is improved and the power consumption of the buffers 31 of the output part 304 of the source driver 300 is reduced. Furthermore, according to the present embodiment, a precharge period Tpr is provided every horizontal period and a precharge voltage of the same polarity is provided during a precharge period Tpr that is immediately before each of the effective scanning periods of two display lines which are the unit of polarity reversal in 2H dot inversion drive scheme. Accordingly, the charge condition of a pixel capacitance Cp is uniformed between the two display lines, enabling to prevent occurrence of transverse unevenness caused by a difference in the amount of charge on a pixel capacitance Cp between the first and second ones of the two display lines.

By precharge on a pixel capacitance Cp by a black voltage application pulse Pb, such as that described above, immediately before the application of a pixel data write pulse Pw, the precharge voltage (VprP or VprN) of the same polarity as that of a data signal S(i) representing pixel data to be written by the pixel data write pulse Pw is provided to each pixel capacitance Cp. Therefore, as shown in (B) of FIG. 8, not only the values of the source line voltage Vs but also the values of the pixel electrode voltage Vp at the point in time of the start of charge on each pixel capacitance Cp (times t2, t5, t8, and t9) are the same, except that there is a difference in polarity with reference to the source center potential VSdc. In this manner, according to the present embodiment, by the combination of precharge on a source line SLi and precharge on a pixel capacitance Cp, a further improvement in charge rate and further uniformity of a charge condition are enabled over conventional precharge techniques.

2. Variant

2.1 First Variant

Next, a liquid crystal display apparatus according to a first variant of the above-described embodiment will be described.

The liquid crystal display apparatus according to the present variant is substantially the same as that of the above-described embodiment, except for a light source driver circuit and a backlight, and thus, the same or corresponding portions are denoted by the same reference numerals and a detailed description thereof is not given.

Figure 9:
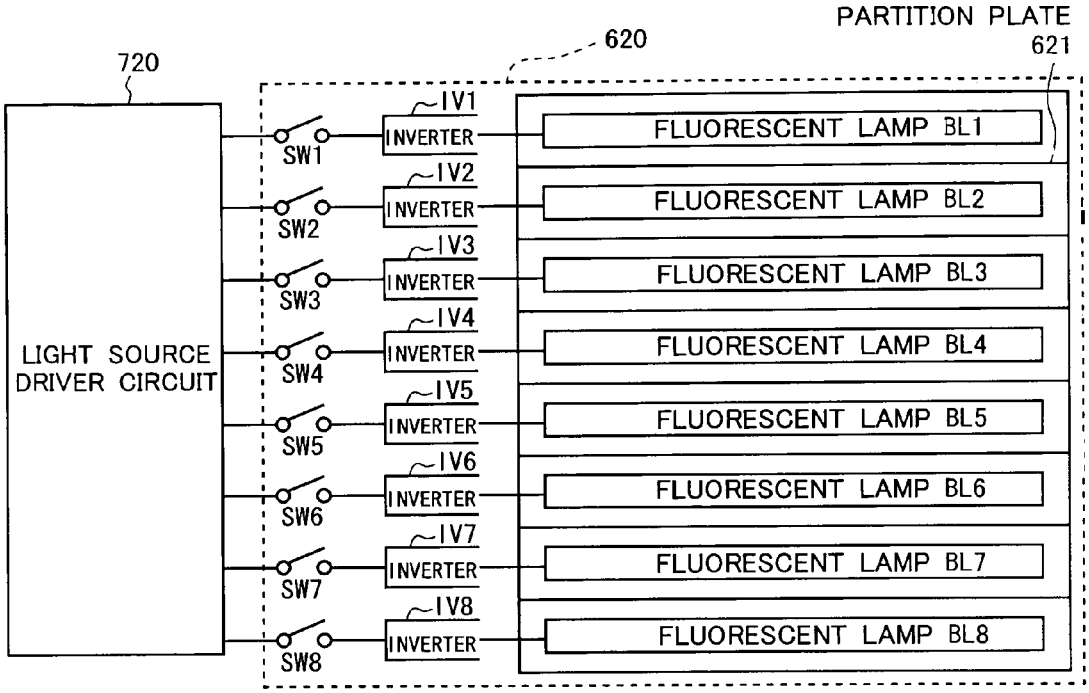
FIG. 9 is a block diagram showing a configuration of a backlight of a liquid crystal display apparatus according to a first variant of the embodiment.

FIG. 9 is a block diagram showing a configuration of a backlight 620 in the present variant, together with a light source driver circuit 720. The backlight 620 is a lighting device configured to be able to be partially turned on/off. The backlight 620 includes a plurality of (eight in an example shown in FIG. 9) direct-type fluorescent lamps BL1 to BL8 serving as a light source and arranged on a backside of a liquid crystal panel 100 serving a s a display part, and in parallel with gate lines; and inverters IV1 to IV8 and switches SW1 to SW8 that respectively correspond to the fluorescent lamps BL1 to BL8. Each fluorescent lamp BLi is connected to the light source driver circuit 720 through its corresponding inverter IVi and switch SWi. Accordingly, the fluorescent lamps BL1 to BL8 can be turned on and off independently of each other, and correspond respectively to eight regions into which the liquid crystal panel 100 is divided in a vertical direction (eight regions into which a pixel array is divided in a column direction) (hereinafter, each of such divided regions is referred to as a "block"). Also, to prevent deterioration of display quality, a partition plate 621 is provided between adjacent fluorescent lamps BLj and BLj+1 (j=1, 2, . . . , 7) so that light from each fluorescent lamp BLi (i=1 to 8) does not leak into blocks other than its corresponding block. Accordingly, each fluorescent lamp, when being turned on, throws light only onto pixel formation portions in its corresponding block. Note that for the fluorescent lamps BL1 to BL8, cold-cathode tubes, for example, can be used.

Although in the present variant the number of fluorescent lamps is eight, the larger the number of fluorescent lamps the smaller the number of gate lines corresponding to one fluorescent lamp, and thus, luminance unevenness is reduced which is caused by the application time of a pixel data signal to a pixel electrode of a pixel formation portion varying between gate lines. However, if the number of fluorescent lamps is large, the numbers of inverters, switches, etc., also increase and thus cost increases and power consumption increases. On the other hand, if the number of fluorescent lamps is reduced, a desired display luminance may not be obtained. In that case, to increase the light emission efficiency of fluorescent lamps, hot-cathode tubes may be used. In the backlight 620, instead of fluorescent lamps, a light source such as LEDs (Light Emitting Diodes) may be used. With LEDs, division of the liquid crystal panel 100 into blocks can be more flexibly performed. Alternatively, between a light source and a liquid crystal display panel, another liquid crystal panel for light shutter may be arranged to transmit or block light from the light source, which may be used as a substitute for a flashing light source.

Figure 10:
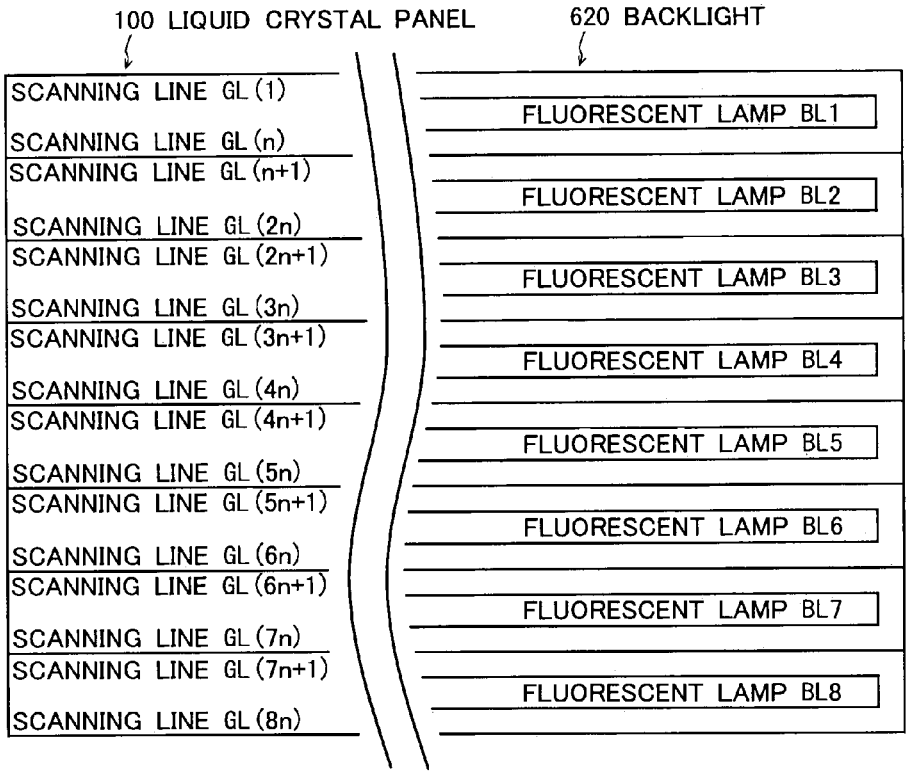
FIG. 10 is a schematic diagram showing a positional relationship between scanning lines of a liquid crystal panel and fluorescent lamps in the first variant.

FIG. 10 shows a positional relationship between scanning lines of the liquid crystal panel 100 and fluorescent lamps in the present variant. Here, the scanning lines indicate gate lines serving as scanning signal lines and an ith scanning line, i.e., a gate line GLi to which a scanning signal G(i) is applied, is represented as "scanning line GL(i)". Note that one scanning line can be equally viewed as pixel formation portions for one row connected thereto.

When the backlight 620 has eight fluorescent lamps, the liquid crystal panel 100 is divided into eight blocks with a number (division value) of scanning lines that is obtained by dividing the number M of scanning lines by eight as one set. For example, when the total number of scanning lines is such that M=8n, the number of scanning lines included in each block is n and thus scanning lines GL(1) to GL(n) correspond to a fluorescent lamp BL1 and scanning lines GL(n+1) to GL(2n) correspond to a fluorescent lamp BL2. Likewise for the others, scanning lines GL(7n+1) to GL(8n) correspond to a fluorescent lamp BL8. When the total number M of scanning lines is not divisible by the number of fluorescent lamps in the backlight, control may be performed assuming that there are such a number of virtual scanning lines that corresponds to a fraction outside the scanning lines GL(1) and GL(8n). Note that a backlight configured in such a manner is called "scanning backlight". The liquid crystal panel and the scanning backlight are described in Japanese Unexamined Patent Publication No. 2000-321551, etc.

The light source driver circuit 720 receives control signals to be provided to the gate driver 400, such as the gate start pulse signal GSP and the gate clock signal GCK, or control signals corresponding thereto, from the display control circuit 200. Based on the control signals, the light source driver circuit 720 turns on/off the switches SW1 to SW8 in the backlight 620 in synchronization with the selection of the gate lines GL1 to GLM, i.e., the scanning lines GL(1) to GL(8n), and thereby controls turning on/off of the fluorescent lamps BL1 to BL8 in the backlight 620, as shown in FIG. 11.

Figure 11:
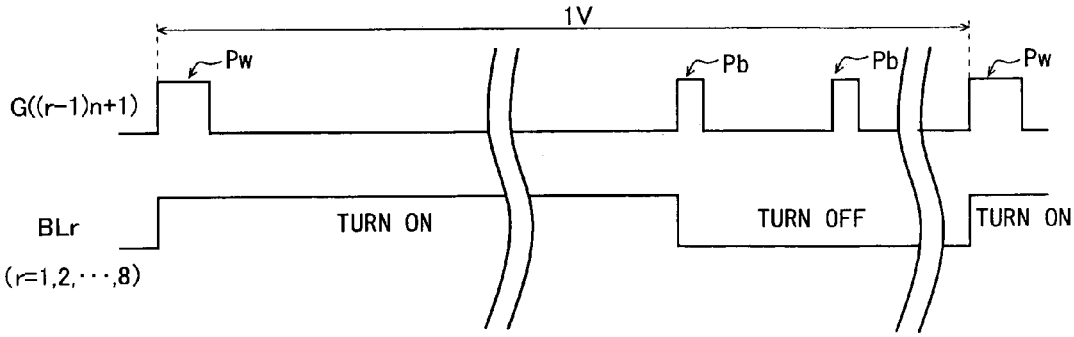
FIG. 11 is a timing chart showing timing of turning on and off of the backlight in the first variant.

FIG. 11 is a timing chart showing timing of turning on and off of the fluorescent lamps BL1 to BL8. Given that a block corresponding to a fluorescent lamp BLi is called "ith block" (i=1, 2, . . . , 8), when a pixel data write pulse Pw is applied to the first scanning line GL(1) among gate lines GL(1) to GL(n) included in the first block, the switch SW1 is turned on, whereby the fluorescent lamp BL1 is turned on. When a black voltage application pulse Pb is applied to the scanning line GL(1), the switch SW1 is turned off, whereby the fluorescent lamp BL1 is turned off. When a pixel data write pulse Pw is applied to the first scanning line GL(n+1) among gate lines GL(n+1) to GL(2n) included in the second block, the switch SW2 is turned on, whereby the fluorescent lamp BL2 is turned on. When a black voltage application pulse Pb is applied, the switch SW2 is turned off, whereby the fluorescent lamp BL2 is turned off. Likewise, when a pixel data write pulse Pw is applied to the first scanning line GL((r−1)·n+1) among gate lines GL((r−1)·n+1) to GL(r·n) included in an rth block, a switch SWr is turned on, whereby a fluorescent lamp BLr is turned on. When a black voltage application pulse Pb is applied, the switch SWr is turned off, whereby the fluorescent lamp BLr is turned off (r=3, 4, . . . , 8).

In the above-described manner, in one frame period, in response to the application of a pixel data write pulse Pw to the scanning lines GL(1) to GL(M), the fluorescent lamps BL1 to BL8 are sequentially turned on and in response to the application of a black voltage application pulse Pb to the scanning lines GL(1) to GL(M), the fluorescent lamps BL1 to BL8 are sequentially turned off. Accordingly, in each pixel formation portion in the liquid crystal panel 100 serving as a display part, when a precharge voltage VprP or VprN is provided, a fluorescent lamp BLk corresponding to a block including the pixel formation portion is in a turn-off state and thus light is not thrown. Therefore, even when the precharge voltages VprP and VprN are not such voltages that correspond to complete black display, by the flashing operation of the backlight 620 as described above, impulse display on the liquid crystal panel 100 is implemented.

Accordingly, in the present variant, flexibility in selecting a value of the precharge voltage VprP or VprN increases. As a result, for example, independent of implementing impulse display, with a view to improving charge characteristics, the value of the precharge voltage VprP or VprN can be determined. Also, for example, to improve the response speed of a liquid crystal as an electro-optic element, an appropriate voltage for providing a pretilt angle to liquid crystal molecules can be selected as the precharge voltages VprP and VprN. In a liquid crystal display apparatus of a vertical alignment mode that controls the alignment direction of liquid crystal molecules by an oblique electric field, by selecting such precharge voltages VprP and VprN that support a pretilt angle, response abnormality is prevented and thus occurrence of a trailing after-image in, moving-image display can be suppressed. This point will be further described below. Note that in the following description the expressions "vertical" and "horizontal" regarding the alignment of liquid crystal molecules respectively indicate vertical and horizontal with respect to a display surface of the liquid crystal display apparatus.

When black display data or low-luminance data indicated by the precharge voltage VprP or VprN is written to a pixel formation portion by a black voltage application pulse Pb, the smaller the absolute value of the precharge voltage VprP or VprN the closer the liquid crystal molecules are to vertical alignment. When, in this vertical alignment state, a voltage for performing a normal write is applied to the liquid crystal layer, the tilt angle of the liquid crystal molecules can be controlled by the magnitude of a voltage to be applied but the falling direction (horizontal direction) cannot be controlled thereby. In this case, the liquid crystal molecules temporarily transition to an alignment state that is stable in terms of energy at that point in time, and thereafter, the liquid crystal molecules move in the proper horizontal direction while rejecting one another. Thus, it takes time for the liquid crystal layer to reach a desired alignment state (transmittance), i.e., for display to reach a target gradation, causing response abnormality over several frames. When response abnormality over several frames occurs, a trailing after-image occurs in moving-image display.

In contrast, when precharge voltages VprP and VprN that support a pretilt angle are selected, as described above, the liquid crystal molecules go into a state of being tilted by the pretilt angle from the vertical alignment. That is, a precharge voltage VprP or VprN provided to a pixel formation portion by a black voltage application pulse Pb is higher by an amount corresponding to the pretilt angle than a voltage that is provided to the pixel formation portion when the liquid crystal molecules align completely vertically. Therefore, when a voltage is applied to the liquid crystal layer in the state of being tilted by the pretilt angle, the liquid crystal molecules fall in a desired horizontal direction and thus the time required for transmittance to approximate a target value can be reduced. Accordingly, response abnormality can be prevented and occurrence of a trailing after-image in moving-image display can be suppressed.

Note that in the above-described variant by a switch SWk being turned off, a corresponding fluorescent lamp BLk is completely turned off (k=1 to 8); however, instead of the fluorescent lamp BLk being completely turned off, by controlling a lamp current in a turn-on state, the lamp luminance may be reduced.

Note also that although in the above-described variant in synchronization with a black voltage application pulse Pb applied to the first scanning line GL((k−1)·n+1) in each block, a fluorescent lamp BLk corresponding to the block is turned off (k=1 to 8), the fluorescent lamp BLk may be turned off in synchronization with a black voltage application pulse Pb applied to other scanning lines in each block. For example, to increase uniformity of an impulse effect brought about by turning-off of a fluorescent lamp BLk in each block, it is desirable to turn off the fluorescent lamp BLk in synchronization with a black voltage application pulse Pb applied to a scanning line at the center in each block.

2.2 Second Variant

Next, a liquid crystal display apparatus according to a second variant of the above-described embodiment will be described. In the liquid crystal display apparatus according to the present variant, a source driver is different from that in the above-described embodiment (FIG. 3) and has an output part configured in a manner shown in FIG. 12. Also, a display control circuit in the present variant generates a charge sharing control signal Csh and a precharge control signal Cpr shown in (C) and (D) of FIG. 13, instead of the precharge control signal Cpr ((C) of FIG. 7) in the above-described embodiment. Other portions of the liquid crystal display apparatus according to the present variant are substantially the same as those in the above-described embodiment, and thus, the same or corresponding portions are denoted by the same reference numerals and a detailed description thereof is not given.

In the present variant, a precharge period Tpr in the above-described embodiment is divided into a charge sharing period Tsh and a precharge period Tpr. For each horizontal period, a precharge operation during the charge sharing period Tsh is performed, followed by a precharge operation during the precharge period. As shown in (C) and (D) of FIG. 13, the charge sharing control signal Csh is a signal for determining a charge sharing period Tsh and is at an H level during the charge sharing period Tsh, and the precharge control signal Cpr is a signal for determining a precharge period Tpr and is at an H level during the precharge period Tpr.

Figure 12:
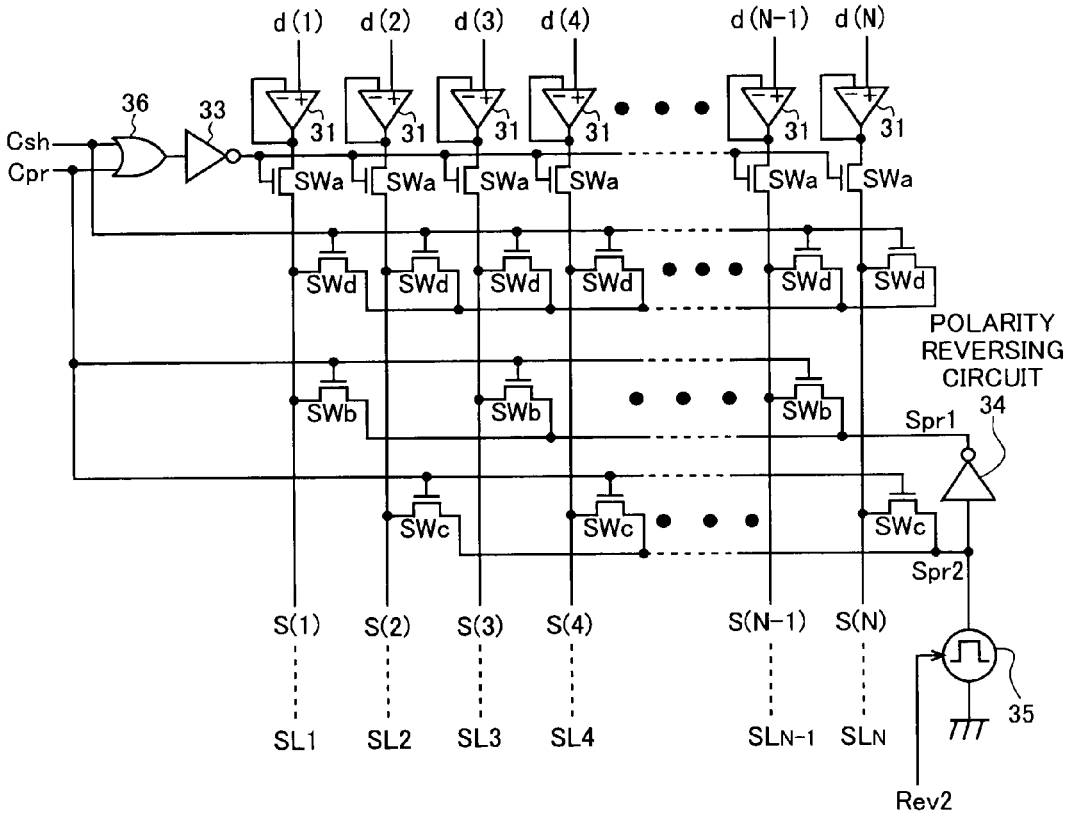
FIG. 12 is a circuit diagram showing a configuration of an output part of a source driver of a liquid crystal display apparatus according to a second variant of the embodiment.

As shown in FIG. 12, in the present variant, such a precharge control signal Cpr and a charge sharing control signal Csh are inputted to an output part 304 of a source driver 300. The output part 304 includes, as with the above-described embodiment (FIG. 3), N output buffers 31 serving as voltage followers and receiving internal data signals d(1) to d(N) generated by a data signal generation part 302 of the source driver 300 and outputting the internal data signals d(1) to d(N) as data signals S(1) to S(N); first MOS transistors SWa respectively inserted between the output buffers 31 and output terminals of the source driver 300; second MOS transistors SWb respectively provided to odd-numbered output terminals of the source driver 300; third MOS transistors SWc respectively provided to even-numbered output terminals of the source driver 300; a precharge power supply 35 that alternately outputs a positive-polarity precharge voltage VprP and a negative-polarity precharge voltage VprN at a predetermined cycle, based on a second polarity reversal control signal Rev2; and a polarity reversing circuit 34 that reverses the polarity of a voltage outputted from the precharge power supply 35. These components are connected in the same manner as that in the above-described embodiment.

In addition to them, the output part 304 of the source driver in the present variant further includes fourth MOS transistors SWd serving as switching elements and respectively provided to the output terminals of the source driver 300; an OR gate 36, and an inverter 33. The output terminals of the source driver are connected to one another through the fourth MOS transistors SWd. The above-described charge sharing control signal Csh and precharge control signal Cpr are inputted to the OR gate 36 and an output terminal of the OR gate 36 is connected, through the inverter 33, to gate terminals of all the first MOS transistors SWa. Thus, a signal obtained by logically inverting an OR signal of the charge sharing control signal Csh and the precharge control signal Cpr is provided to the gate terminals of all the first MOS transistors SWa. Furthermore, the precharge control signal Cpr is provided to gate terminals of all the second and third MOS transistors SWb and SWc and the charge sharing control signal Csh is provided to gate terminals of all the fourth MOS transistors SWd.

According to such a configuration, during periods other than a charge sharing period Tsh and a precharge period Tpr, the first MOS transistors SWa are in an on state and the second to fourth MOS transistors SWb, SWc, and SWd are in an off state, and thus, the internal data signals d(1) to d(N) are outputted, as data signals S(1) to S(N), from the source driver 300 through the output buffers 31 and the first MOS transistors SWa and applied to source lines SL1 to SLN.

On the other hand, during each of the charge sharing period Tsh and the precharge period Tpr, the first MOS transistors SWa are in an off state. Since during the charge sharing period Tsh the fourth MOS transistors SWd are in an on state, the source lines SL1 to SLN respectively connected to the output terminals of the source driver 300 are short-circuited to one another through the fourth MOS transistors SWd. In the present variant, as with the above-described embodiment, a (2H) dot inversion drive scheme is adopted and thus the voltages of adjacent source lines have opposite polarities. Accordingly, the voltage of each source line SLi has a certain intermediate potential between positive polarity and negative polarity potentials during the charge sharing period Tsh. Here, the polarity of each data signal S(i), i.e., the potential of a source line SLi, is reversed with reference to a source center potential VSdc which is a direct-current level of the data signal S(i), and thus, as shown in (E) of FIG. 13, during the charge sharing period Tsh, the potential of the source line SLi becomes substantially equal to the source center potential VSdc of the data signal S(i). Note, however, that here an ideal data signal waveform is shown and thus when the charge sharing period Tsh is short, the potential of the source line SLi may not completely reach the source center potential VSdc in practice.

Immediately after the ending of the charge sharing period Tsh, a precharge period Tpr (the precharge control signal Cpr is at an H level) sets in. During the precharge period Tpr, the output part 304 of the source diver operates in the same manner as in the above-described embodiment, and as shown in (E) of FIG. 13, each data signal S(i), i.e., the potential of a source line SLi, becomes equal to the positive-polarity or negative-polarity precharge voltage VprP or VprN. Note, however, that since immediately before the precharge period Tpr the source line SLi substantially reaches the source center potential VSdc, the amount of potential change in the source line SLi during the precharge period Tpr is significantly reduced over the case of the above-described embodiment.

Figure 13:
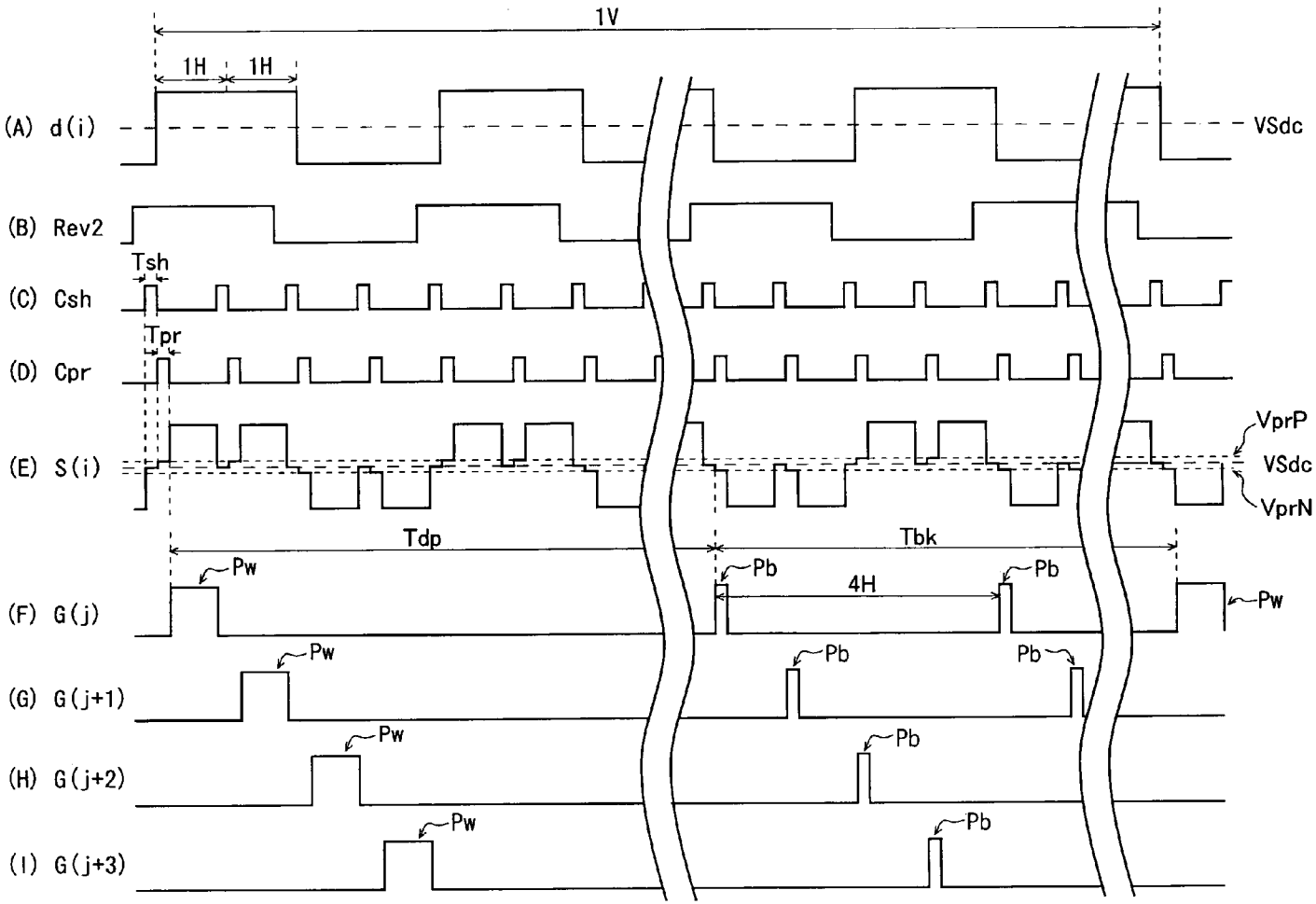
FIG. 13 consists of signal waveform diagrams (A) to (I) for describing the operation of the liquid crystal display apparatus according to the second variant.

As shown in (F) to (I) of FIG. 13, also in the present variant, black voltage application pulses Pb are generated by a gate driver 400 such that the same temporal relationships between the black voltage application pulses Pb and a pixel data write pulse Pw and a data signal S(i) as those in the above-described embodiment are obtained. Note, however, that since the precharge period Tpr in the present variant is shorter than that in the above-described embodiment, the width of a black voltage application pulse Pb is accordingly narrower than that in the above-described embodiment. However, the narrower width of a black voltage application pulse Pb can be compensated for by increasing the number of black voltage application pulses Pb in one frame period.

In this manner, also in the present variant, a source line SLi is precharged and application of a black voltage for implementing impulse also serves as precharge on a pixel capacitance Cp, and thus, the same effects as those obtained by the above-described embodiment can be obtained. Moreover, according to the present variant, since by a charge sharing operation (charge movement between source lines) performed immediately before each precharge period Tpr, the amount of potential change in a source line SLi during the precharge period Tpr is significantly reduced, the power consumption of the source driver 300 can be further reduced over the above-described embodiment. Note that although in the configuration shown in FIG. 12 a switching element group composed of the fourth MOS transistors SWd for a charge sharing operation is included in (the output part 304 of) the source driver 300, such a switching element group may be provided external to the source driver 300 and may be implemented by, for example, TFTs on a liquid crystal panel.

2.3 Other Variants

Figure 14:
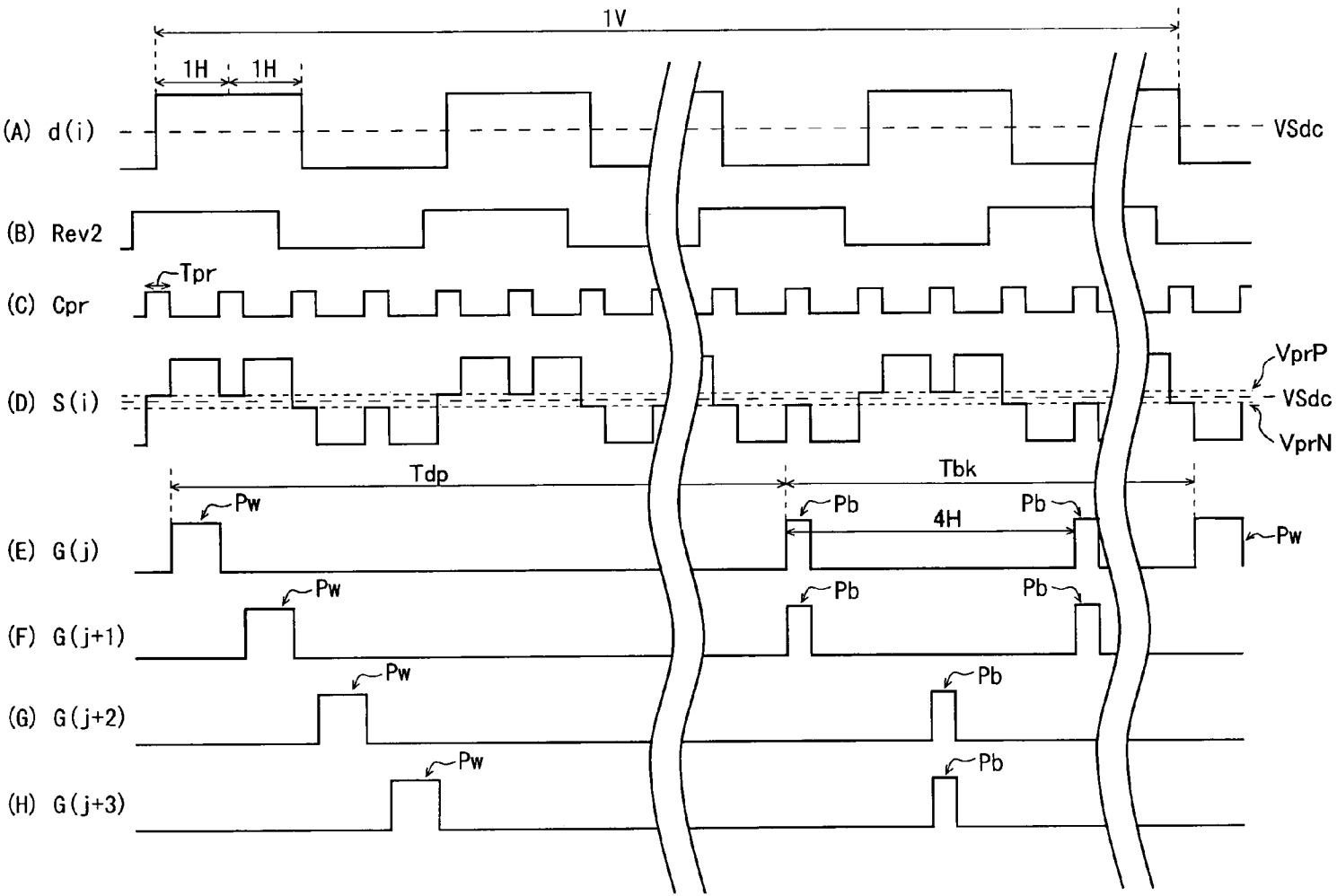
FIG. 14 consists of signal waveform diagrams (A) to (H) for describing a driving method for a liquid crystal display apparatus according to another variant of the embodiment.

In the above-described embodiment, as shown in FIGS. 7 and 8, in each of the scanning signal G(1) to G(M), a black voltage application pulse Pb appears shifted by one horizontal period. Due to this, as shown in (B) and (C) of FIG. 8, in the scanning signals G(k), G(k+2), and G(k+4) corresponding to the first one of two display lines which are the unit of polarity reversal in a 2H dot inversion drive scheme, a black voltage application pulse Pb appears during a precharge period Tpr at a time when the polarity of a source line voltage Vs is reversed, while in the scanning signals G(k+1) and G(k+3) corresponding to the second one of the two display lines, a black voltage application pulse Pb appears during a precharge period Tpr at a time when the polarity of the source line voltage Vs is not reversed. As can be seen from (B) of FIG. 8, in terms of precharge on a pixel capacitance Cp, it is desirable to precharge when the polarity of the source line voltage Vs is not reversed rather than to precharge when the polarity of the source line voltage Vs is reversed. Therefore, as shown in FIG. 14, it is also desirable that each of black voltage application pulses Pb appear when the polarity of a source line voltage is not reversed (thus when the polarity of a data signal S(i) is not reversed). To do this, timing at which a black voltage application pulse Pb appears in the scanning signals G(k) and G(k+2) corresponding to the first one of two display lines which are the unit of polarity reversal in a 2H dot inversion drive scheme should be delayed by one horizontal period. In an example shown in FIG. 14, the configuration may be the same as that in the above-described embodiment except for a gate driver ((A) to (D) of FIG. 14).

Figure 15:
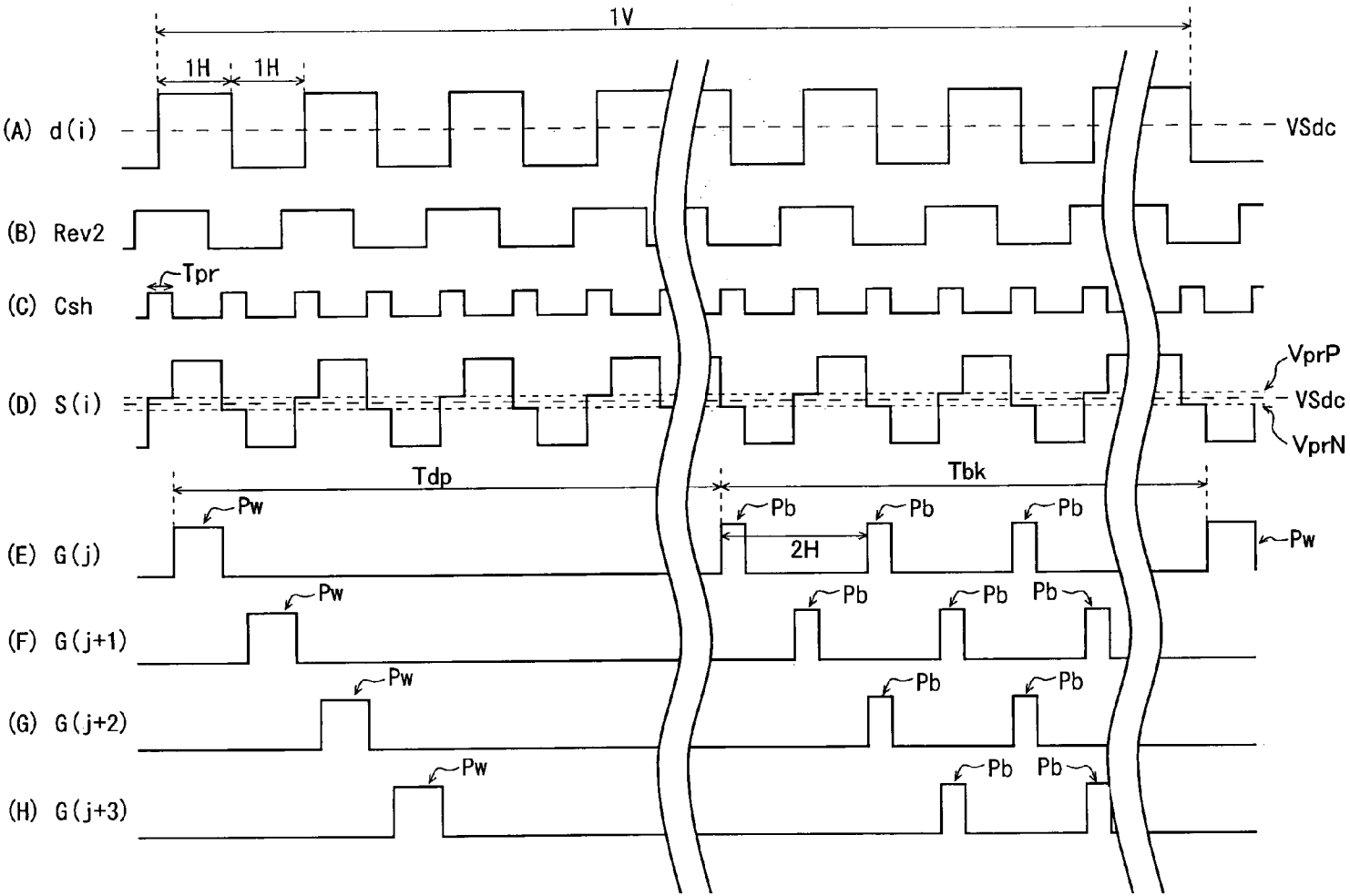
FIG. 15 consists of signal waveform diagrams (A) to (H) for describing a driving method for a liquid crystal display apparatus according to still another variant of the embodiment.

Although in the above-described embodiment a 2H dot inversion drive scheme is adopted, the present invention is not limited thereto and can generally be applied also to a liquid crystal display apparatus of an nH dot inversion drive scheme (n is a natural number). For example, when the present invention is applied to a liquid crystal display apparatus of a 1H dot inversion drive scheme, waveforms of various signals including a data signal S(i) and a scanning signal G(j) are such as those shown in FIG. 15. Also, the present invention can be applied to an n-line inversion drive scheme that is not a dot inversion drive scheme.

Although in the above-described embodiment a precharge period Tpr is provided for each horizontal period, the present invention is not limited thereto. Specifically, as long as the configuration is such that in each pixel formation portion a precharge voltage of the same polarity as that of a data signal S(i) to be provided by a pixel data write pulse Pw during a next frame period is provided by a black voltage application pulse Pb, a precharge period Tpr may be provided for each two or more horizontal periods.

The configuration of the gate driver 400 in the above-described embodiment is not limited to that shown in (A) and (B) of FIG. 5 and can be any as long as the gate driver 400 generates scanning signals G(1) to G(M) such as those shown in (E) and (F) of FIG. 6 or (E) to (H) of FIG. 7. Although in the above-described embodiment, as shown in (E) and (F) of FIG. 6, three black voltage application pulses Pb are applied to each gate line GLj in one frame period, the number of black voltage application pulses Pb in one frame period, i.e., the number of times one gate line is in a selected state during a precharge period Tpr per frame period, is not limited to three and can be any number greater than or equal to one that can bring display to a black level (bring a pixel voltage Vp substantially equal to the precharge voltage VprP or VprN).

Although in the present embodiment a black voltage application pulse Pb is applied to each gate line GLj at a point in time at which an image display period Tdp with a length of a ⅔ frame period has elapsed since application of a pixel data write pulse Pw ((E) of FIG. 7) and black insertion of the order of substantially a ⅓ frame period is performed for each frame, a black display period Tbk is not limited to the ⅓ frame period. Extension of the black display period TbK increases the effect of implementation of impulse and thus is effective in improving moving-image display performance (suppression of a trailing after-image, etc.); however reduction in display luminance is caused and thus an appropriate black display period Tbk is set taking into account the effect of implementation of impulse and display luminance.

Figure 16:
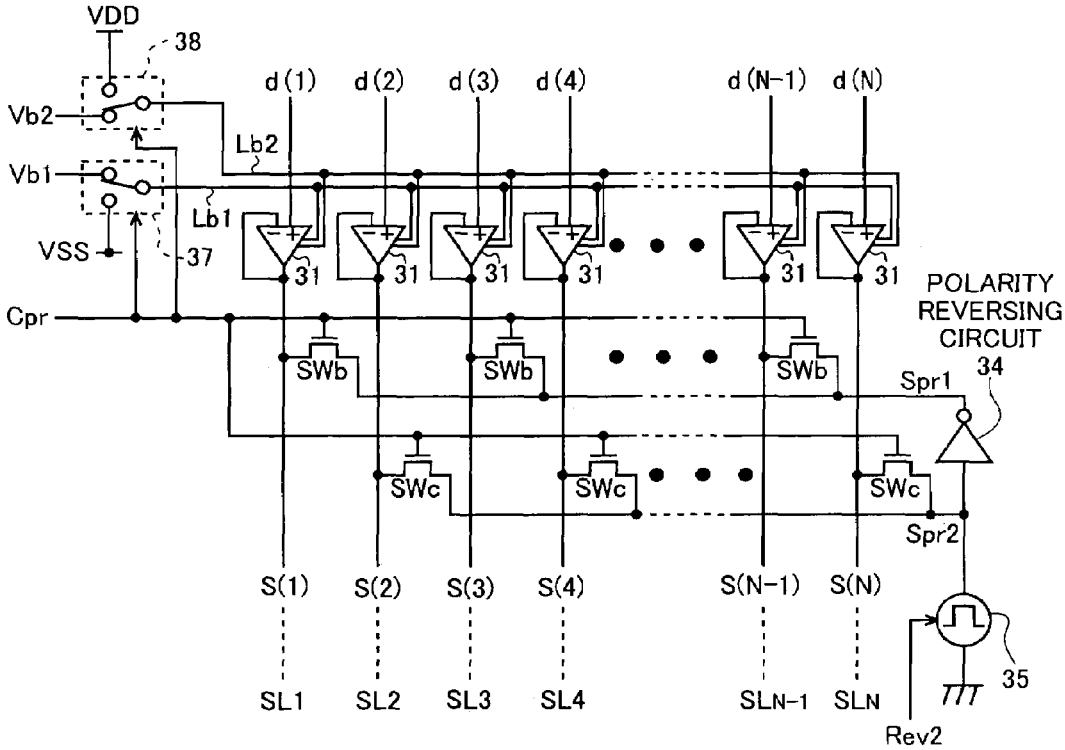
FIG. 16 is a circuit diagram showing a configuration of an output part of a source driver of a liquid crystal display apparatus according to yet another variant of the embodiment.

In the above-described embodiment, voltage followers are used as the output buffers 31 of the source driver 300. To operate the voltage followers, a supply of a bias voltage is required. However, the voltage followers serving as the output buffers 31 consume power due to an internal current while a bias voltage is supplied, even when source lines SLi are not driven. Hence, it is desirable that during a precharge period Tpr where an electrical connection between each output buffer 31 and a corresponding source line SLi is interrupted, a supply of a bias voltage to each output buffer 31 be stopped so that an internal current does not flow. FIG. 16 is a circuit diagram showing an exemplary configuration of an output part 304 of a source driver for that.

Figure 17:
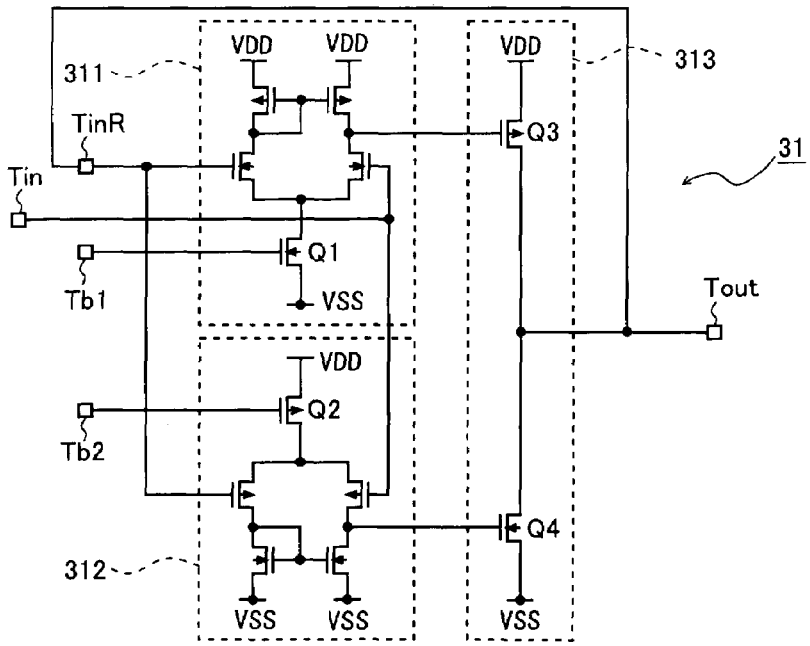
FIG. 17 is a circuit diagram showing a configuration of an output buffer in the output part of the source driver shown in FIG. 16.

FIG. 17 is a circuit diagram showing an exemplary configuration of an output buffer 31 used in the configuration of FIG. 16. As shown in FIG. 17, the output buffer 31 is composed of a first differential amplifier 311 having an N-channel type MOS transistor (hereinafter, abbreviated as the "Nch transistor") Q1 that functions as a constant current source; a second differential amplifier 312 having a P-channel type MOS transistor (hereinafter, abbreviated as the "Pch transistor") Q2 that functions as a constant current source; and a push-pull type output circuit 313 composed of a Pch transistor Q3 and an Nch transistor Q4. The output buffer 31 has a non-inverting input terminal Tin, an inverting input terminal TinR, an output terminal Tout, a first bias terminal Tb1 connected to a gate terminal of the Nch transistor Q1, and a second bias terminal Tb2 connected to a gate terminal of the Pch transistor Q2. The output terminal Tout is directly connected to the inverting input terminal TinR. The output buffer 31 operates as a voltage follower when a predetermined first bias voltage Vb1 is provided to the first bias terminal Tb1 and a predetermined second bias voltage Vb2 is provided to the second bias terminal Tb2. On the other hand, when a ground potential VSS is provided to the first bias terminal Tb1 and a power supply voltage VDD is provided to the second bias terminal Tb2, the Nch transistor Q1 and the Pch transistor Q2 are turned off, whereby the Pch transistor Q3 and the Nch transistor Q4 of the output circuit 313 are also turned off. This indicates that the output buffer 31 goes into a pause state. In the pause state, a current does not flow through the output buffer 31 and an output therefrom is in a high-impedance state.

In the exemplary configuration in FIG. 16, unlike the above-described embodiment, the first MOS transistors SWa and the inverter 33 are eliminated and the output terminal Tout of each output buffer 31 is directly connected to one of the output terminals of the source driver 300. On the other hand, the exemplary configuration includes first and second selector switches 37 and 38; a first bias line Lb1 for connecting a first bias terminal Tb1 of each output buffer 31 to the first selector switch 37; and a second bias line Lb2 for connecting a second bias terminal Tb2 of each output buffer 31 to the second selector switch 38. Note that an internal data signal d(i) is provided to the non-inverting input terminal Tin serving as an input terminal of each output buffer 31. The first selector switch 37 is a switch for switching a voltage to be provided to the first bias line Lb1, based on the precharge control signal Cpr. By the first selector switch 37, to the first bias line Lb1 is provided a first bias voltage Vb1 when the precharge control signal Cpr is at an L level, and is provided a ground potential VSS when at an H level. The second selector switch 38 is a switch for switching a voltage to be provided to the second bias line Lb2, based on the precharge control signal Cpr. By the second selector switch 38, to the second bias line Lb2 is provided a second bias voltage Vb2 when the precharge control signal Cpr is at an L level, and is provided a power supply voltage VDD when at an H level. Accordingly, each output buffer 31 operates as a voltage follower when the precharge control signal Cpr is at an L level and is in a pause state when the precharge control signal Cpr is at an H level. In this manner, the first and second selector switches 37 and 38 function as pause control parts for each output buffer 31. Other configurations of the output part of the source driver shown in FIG. 16 are the same as those of the output part 304 of the source driver in the above-described embodiment, and thus, the same portions are denoted by the same reference numerals and description thereof is not given. Note that the configuration for generating the first and second bias voltages Vb1 and Vb2 is the same as that in conventional cases, and thus, description thereof is not given.

According to the configuration as described above, during periods other than a precharge period Tpr, the precharge control signal Cpr is at an L level and thus each internal data signal d(i) is applied, as a data signal S(i), to a source line SLi through a corresponding output buffer 31 (i=1 to N). On the other hand, during the precharge period Tpr, the precharge control signal Cpr is at an H level, and thus, the output buffers 31 are in a pause state and outputs therefrom are in a high-impedance state; accordingly, a positive-polarity or negative-polarity precharge voltage is applied to each source line SLi through a corresponding second MOS transistor SWb or third MOS transistor SWc. In this manner, while the same functions as those in the above-described embodiment are implemented, the power consumption of the source driver 300 can be reduced by causing each output buffer to be in a pause state during a precharge period Tpr.

Note that the configuration of the output buffers 31 is not limited to that in FIG. 17 and can be any as long as the output buffers 31 can be caused to be in a pause state by reducing or cutting off an internal current by switching of a bias voltage. In the case of a configuration in which outputs from output buffers 31 being in a pause state do not go into a high-impedance state, as with the above-described embodiment, first MOS transistors SWa may be inserted between the output buffers 31 and output terminals of a source driver.

In the above-described embodiment, as shown in FIG. 3, a precharge circuit is composed of the first MOS transistors SWa, the second MOS transistors SWb, the third MOS transistors SWc, the inverter 33, the polarity reversing circuit 34, and the precharge power supply 35. During a precharge period Tpr, the precharge circuit interrupts application of the internal data signals d(1) to d(N) to the source lines SL1 to SLN and provides the first precharge signal Spr1 to odd-numbered source lines $SLi_{od}$ ($i_{od}$=1, 3, 5, . . . ) and the second precharge signal Spr2 to even-numbered source lines $SLi_{ev}$ ($i_{ev}$=2, 4, 6, . . . ). Although in the above-described embodiment the precharge circuit is included in the source driver 300, the configuration may be such that part or all of the precharge circuit is provided external to the source driver 300; for example, the configuration may be such that using TFTs, the precharge circuit is integrally formed with the pixel array in the display part 100.

3. Television Receiver

Figure 18:
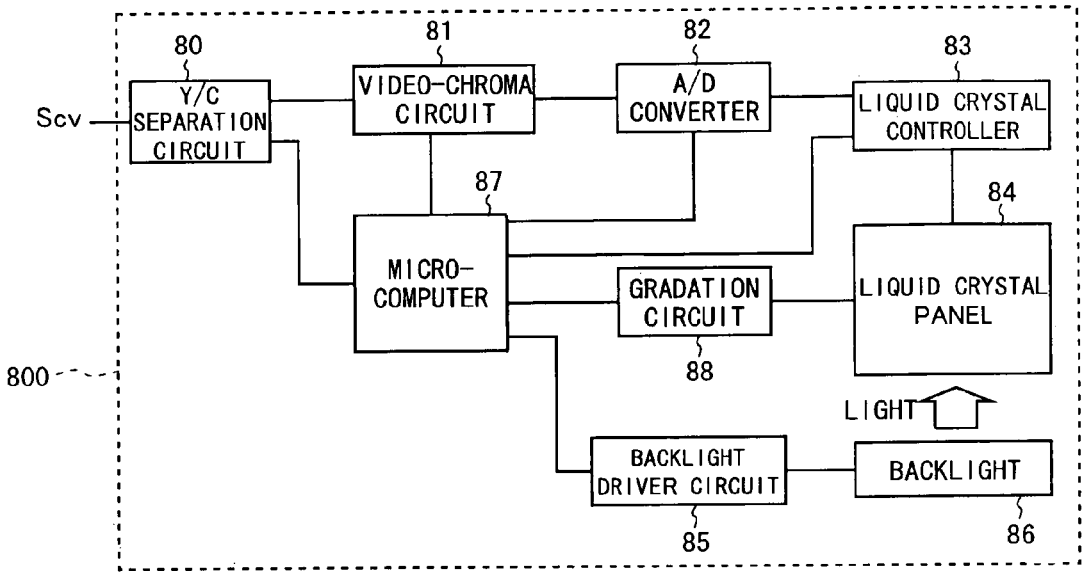
FIG. 18 is a block diagram showing an exemplary configuration of a display apparatus for a television receiver using a liquid crystal display apparatus according to the present invention.

Next, an example will be described in which a liquid crystal display apparatus according to the present invention is used in a television receiver. FIG. 18 is a block diagram showing a configuration of a display apparatus 800 for the television receiver. The display apparatus 800 includes a Y/C separation circuit 80, a video-chroma circuit 81, an A/D converter 82, a liquid crystal controller 83, a liquid crystal panel 84, a backlight driver circuit 85, a backlight 86, a microcomputer 87, and a gradation circuit 88. Note that the liquid crystal panel 84 includes a display part composed of an active matrix-type pixel array and a source driver and a gate driver for driving the display part.

In the display apparatus 800 of the above-described configuration, first, a composite color video signal Scv serving as a television signal is inputted from an external source to the Y/C separation circuit 80 where the signal Scv is separated into a luminance signal and a color signal. The luminance signal and color signal are converted, by the video-chroma circuit 81, into an analog RGB signal corresponding to the primary colors of light and the analog RGB signal is further converted, by the A/D converter 82, into a digital RGB signal. The digital RGB signal is inputted to the liquid crystal controller 83. Also, the Y/C separation circuit 80 takes out horizontal and vertical synchronizing signals from the composite color video signal Scv inputted from the external source. These synchronizing signals are also inputted to the liquid crystal controller 83 through the microcomputer 87.

The liquid crystal controller 83 outputs a driver data signal based on the digital RGB signal (corresponding to a digital video signal Dv in the above-described embodiment) outputted from the A/D converter 82. Also, the liquid crystal controller 83 generates, based on the synchronizing signals, timing control signals for causing the source driver and the gate driver in the liquid crystal panel 84 to operate in the same manner as in the above-described embodiment, and provides the timing control signals to the source driver and the gate driver. The gradation circuit 88 generates gradation voltages respectively for the primary colors R, G, and B for color display. The gradation voltages are also supplied to the liquid crystal panel 84.

In the liquid crystal panel 84, based on the driver data signal, timing control signals, and gradation voltages, driving signals (data signals, scanning signals, etc.) are generated by the internal source driver, gate driver, etc. (see FIG. 7). Based on the driving signals, a color image is displayed on the internal display part. Note that to display an image by the liquid crystal panel 84, light needs to be thrown from the back of the liquid crystal panel 84. In the display apparatus 800, the backlight 86 is driven by the backlight driver circuit 85 under the control of the microcomputer 87, and thereby light is thrown onto a backside of the liquid crystal panel 84.

The overall control of the system including the above-described process is performed by the microcomputer 87. Note that for a video signal (composite color video signal) to be inputted from an external source, not only a video signal based on television broadcasting but also a video signal imaged by a camera, a video signal supplied through Internet lines, etc., can be used. In the display apparatus 800, image display based on various video signals is enabled.

Figure 19:
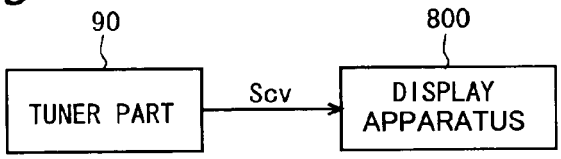
FIG. 19 is a block diagram showing the overall configuration including a tuner part of the television receiver using the liquid crystal display apparatus according to the present invention.

When an image based on television broadcasting is displayed on the display apparatus 800 of the above-described configuration, as shown in FIG. 19, a tuner part 90 is connected to the display apparatus 800. The tuner part 90 extracts a signal of a channel to be received, from received waves (high-frequency signals) received by an antenna (not shown), converts the signal to an intermediate-frequency signal, and takes out a composite color video signal Scv as a television signal by subjecting the intermediate-frequency signal to detection. The composite color video signal Scv is inputted to the display apparatus 800, as previously described, and an image based on the composite color video signal Scv is displayed by the display apparatus 800.

Figure 20:
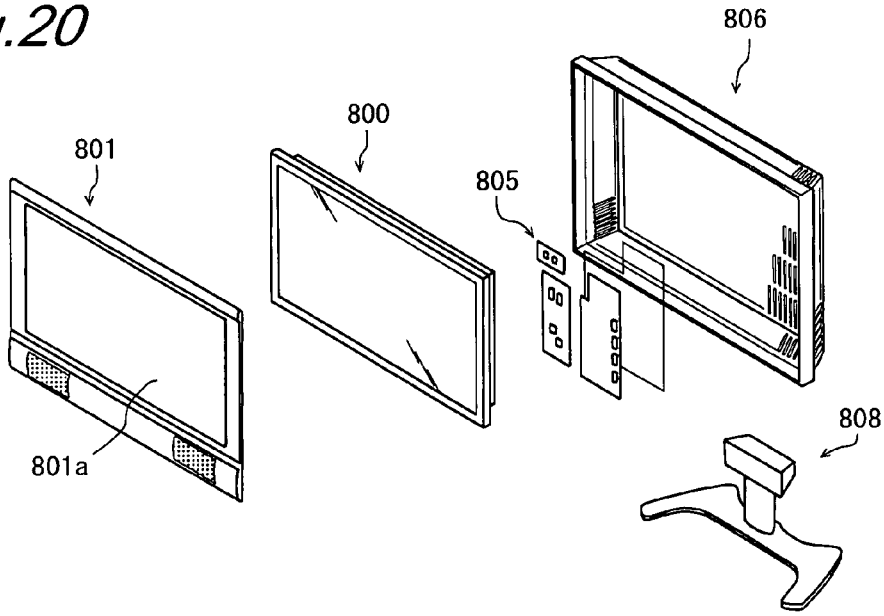
FIG. 20 is an exploded perspective view showing a mechanical configuration of the television receiver.
Figure 21:
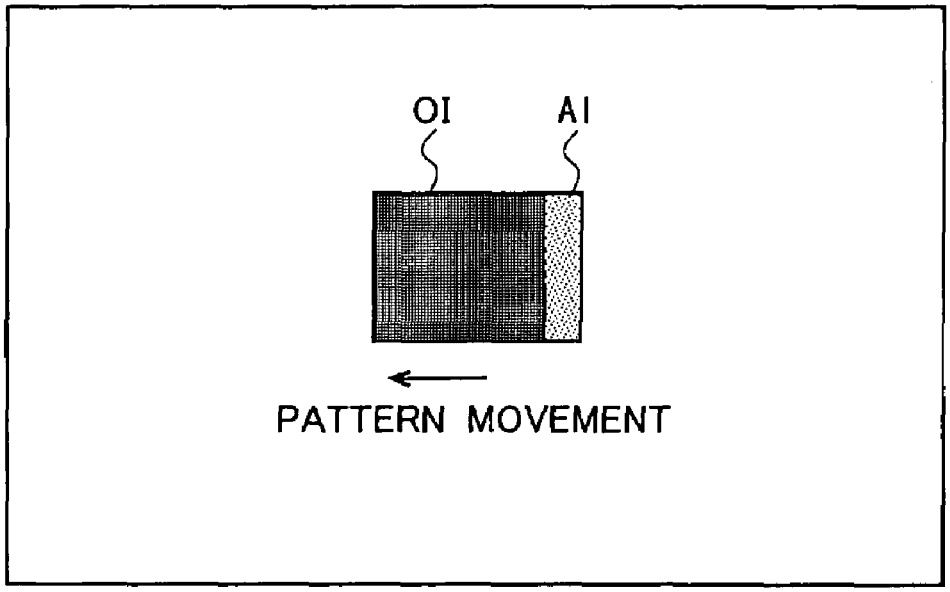
FIG. 21 is a diagram for describing a problem caused in moving-image display on a hold-type display apparatus.

FIG. 20 is an exploded perspective view showing an example of a mechanical configuration for when a display apparatus of the above-described configuration is used as a television receiver. In the example shown in FIG. 20, the television receiver has, as its components, a first housing 801 and a second housing 806 in addition to the above-described display apparatus 800. The television receiver is configured such that the display apparatus 800 is sandwiched between the first housing 801 and the second housing 806 in an enclosing manner. The first housing 801 has formed therein an opening portion 801*a* that allows an image displayed on the display apparatus 800 to be transmitted therethrough. The second housing 806 covers the back side of the display apparatus 800. In the second housing 806, an operation circuit 805 for operating the display apparatus 800 is provided and a support member 808 is attached to the bottom.

According to a television receiver as described above, moving-image display performance is improved by impulse display implemented by a black voltage application pulse Pb. Black insertion for the implementation of impulse also serves as precharge on a pixel capacitance Cp and each source line is also precharged every horizontal period. Accordingly, by an improvement in the charge rate of a pixel capacitance and the uniformity of a charge condition, the display quality of an image is improved.

INDUSTRIAL APPLICABILITY

The present invention is applied to an active matrix-type liquid crystal display apparatus and is suitable particularly for an active matrix-type liquid crystal display apparatus that displays a moving image.

The invention claimed is:

1. An active matrix-type liquid crystal display apparatus comprising:

a plurality of data signal lines;

a plurality of scanning signal lines intersecting the plurality of data signal lines;

a plurality of pixel formation portions arranged in a matrix form so as to correspond to respective intersection points of the plurality of data signal lines and the plurality of scanning signal lines; and a driver circuit for driving the plurality of data signal lines and the plurality of scanning signal lines, wherein the driver circuit includes:

a data signal line driver circuit for generating a plurality of data signals representing an image to be displayed, as voltage signals whose polarities are reversed every predetermine number of horizontal periods, and applying the plurality of data signals to the plurality of data signal lines;

a precharge circuit for providing, as a precharge voltage, a predetermined positive-polarity or negative-polarity voltage to the plurality of data signal lines during a predetermined precharge period, every one or more predetermined number of horizontal periods; and a scanning signal line driver circuit for selectively driving the plurality of scanning signal lines such that each of the plurality of scanning signal lines is in a selected state during an effective scanning period which is a period other than the precharge period, at least once in each frame period, and the scanning signal line having been in the selected state during the effective scanning period is in a selected state during the precharge period, at least once in a period from a first point in time at which the scanning signal line is changed from the selected state to a non-selected state to a second point in time at which the scanning signal line goes into a selected state during an effective scanning period in a next frame period, each of the plurality of pixel formation portions includes:

a switching element that is in an on state when a scanning signal line passing through a corresponding intersection point is in a selected state, and is in an off state when the scanning signal line is in a non-selected state; and a pixel capacitance connected, through the switching element, to a data signal line passing through the corresponding intersection point, and the driver circuit applies the precharge voltage to each data signal line by the precharge circuit and selects each scanning signal line by the scanning signal line driver circuit, such that a polarity of the precharge voltage provided to each data signal line when any one of the scanning signal lines is caused to be in a selected state during the precharge period in each frame period matches a polarity of a data signal applied to said data signal line when said scanning signal line is caused to be in a selected state during the effective scanning period in a next frame period.

2. The liquid crystal display apparatus according to claim 1, wherein the precharge circuit reverses a polarity of the precharge voltage to be provided to each data signal line, in response to polarity reversal of a data signal to be applied to said data signal line.

3. The liquid crystal display apparatus according to claim 2, wherein the precharge circuit:

generates the precharge voltage to be provided to each data signal line, such that a polarity of the precharge voltage provided to each data signal line during each precharge period matches a polarity of a data signal applied to said data signal line immediately after said precharge period, and provides the precharge voltage to each data signal line using a predetermined period as the precharge period when a polarity of each data signal is reversed.

4. The liquid crystal display apparatus according to claim 1, wherein the scanning signal line driver circuit causes the scanning signal line having been in the selected state during the effective scanning period to be in a selected state during the precharge period, a plurality of times in the period from the first point in time to the second point in time.

5. The liquid crystal display apparatus according to claim 4, wherein the precharge circuit reverses a polarity of the precharge voltage to be provided to each data signal line, in response to polarity reversal of a data signal to be applied to said data signal line, and the scanning signal line driver circuit causes the scanning signal line having been in the selected state during the effective scanning period to be in a selected state during the precharge period, the plurality of times in the period from the first point in time to the second point in time, at intervals of twice the predetermined number of horizontal periods, the predetermined number of horizontal periods constituting a cycle of polarity reversal of the plurality of data signals.

6. The liquid crystal display apparatus according to claim 1, wherein the data signal line driver circuit generates the plurality of data signals such that polarities of the data signals are reversed every two or more predetermined number of horizontal periods, and the precharge circuit provides the precharge voltage to the plurality of data signal lines during the precharge period, every horizontal period.

7. The liquid crystal display apparatus according to claim 6, wherein the scanning signal line driver circuit causes the scanning signal line having been in the selected state during the effective scanning period to be in a selected state during a precharge period where polarities of the plurality of data signals are not reversed, in the period from the first point in time to the second point in time.

8. The liquid crystal display apparatus according to claim 1, wherein when the scanning signal line driver circuit causes any one of the plurality of scanning signal lines to be in a selected state during the effective scanning period, the scanning signal line driver circuit selects said any one of the plurality of scanning signal lines such that a period of the selected state does not overlap with the precharge period.

9. The liquid crystal display apparatus according to claim 1, further comprising:

a display control circuit for controlling the driver circuit, wherein the precharge circuit includes:

a first switching element group for interrupting application of the plurality of data signals to the plurality of data signal lines when in an off state;

a second switching element group, composed of switching elements connected to one of two data signal line groups obtained by grouping the plurality of data signal lines such that a data signal line group to which data signals of a same polarity are applied is treated as one group;

a third switching element group composed of switching elements connected to other one of the two data signal line groups; and a precharge signal generating circuit for generating a precharge signal in which a positive-polarity voltage and a negative-polarity voltage serving as the precharge voltages alternately appear, and providing the precharge signal to the one data signal line group through the second switching element group when the second switching element group is in an on state; and generating a reversed precharge signal obtained by reversing a polarity of the precharge voltage and providing the reversed precharge signal to the other data signal line group through the third switching element group when the third switching element group is in an on state, and the display control circuit causes, during the precharge period, the first switching element group to be in an off state and the second and third switching element groups to be in an on state, and causes, during periods other than the precharge period, the first switching element group to be in an on state and the second and third switching element groups to be in an off state.

10. The liquid crystal display apparatus according to claim 9, wherein the display control circuit generates, as a polarity reversal signal, a control signal for causing the data signal line driver circuit to reverse polarities of the plurality of data signals every the predetermined number of horizontal periods, and the precharge signal generating circuit, generates the precharge signal such that a polarity of the precharge signal is reversed according to the polarity reversal signal.

11. The liquid crystal display apparatus according to claim 1, wherein the precharge period is shorter than a period during which the plurality of data signals representing the image are applied to the plurality of data signal lines.

12. The liquid crystal display apparatus according to claim 1, wherein each of the plurality of pixel formation portions is configured to form a black pixel when a voltage is not applied to a corresponding pixel capacitance, and the precharge voltage is a voltage corresponding to black display.

13. The liquid crystal display apparatus according to claim 1, wherein the data signal line driver circuit generates the plurality of data signals such that data signals to be respectively applied to adjacent data signal lines have different polarities, the driver circuit includes a circuit for interrupting application of the plurality of data signals to the plurality of data signal lines during a predetermined period, every one or more predetermined number of horizontal periods, and short-circuiting the plurality of data signal lines during a predetermined charge sharing period included in the predetermined period, and the precharge period is included in the predetermined period during which the application of the plurality of data signals to the plurality of data signal lines is interrupted, and is a period following the charge sharing period.

14. The liquid crystal display apparatus according to claim 1, wherein the data signal line driver circuit includes:

a plurality of buffers for outputting the plurality of data signals to be applied to the plurality of data signal lines; and a pause control part for causing the plurality of buffers to pause during the precharge period.

15. The liquid crystal display apparatus according to claim 1, further comprising:

a lighting device configured to be able to be partially turned on/off for throwing light onto the plurality of pixel formation portions; and a lighting control part for controlling turning on and off of the lighting device according to selection of each scanning signal line, wherein the plurality of pixel formation portions share a liquid crystal layer and control an amount of transmission of light from the lighting device through the liquid crystal layer, according to voltages held in the pixel capacitances respectively included therein, and thereby form the image, and the lighting control part controls turning on and off of the lighting device such that light is thrown from the lighting device onto a pixel formation portion including a pixel capacitance that is charged by any one of the plurality of data signals with any one of the plurality of scanning signal lines caused to be in a selected state during the effective scanning period, and light is not thrown from the lighting device onto a pixel formation portion including a pixel capacitance that is charged by the precharge voltage with any one of the plurality of scanning signal lines caused to be in a selected state during the precharge period.

16. The liquid crystal display apparatus according to claim 15, wherein the precharge voltage is a voltage for providing a pretilt angle to liquid crystal molecules in the liquid crystal layer.

17. A television receiver comprising the liquid crystal display apparatus according to claim 1.

18. A driver circuit of an active matrix-type liquid crystal display apparatus including a plurality of data signal lines; a plurality of scanning signal lines intersecting the plurality of data signal lines; and a plurality of pixel formation portions arranged in a matrix form so as to correspond to respective intersection points of the plurality of data signal lines and the plurality of scanning signal lines, the driver circuit comprising:

a data signal line driver circuit for generating a plurality of data signals representing an image to be displayed, as voltage signals whose polarities are reversed every predetermine number of horizontal periods, and applying the plurality of data signals to the plurality of data signal lines;

a precharge circuit for providing, as a precharge voltage, a predetermined positive-polarity or negative-polarity voltage to the plurality of data signal lines during a predetermined precharge period, every one or more predetermined number of horizontal periods; and a scanning signal line driver circuit for selectively driving the plurality of scanning signal lines such that each of the plurality of scanning signal lines is in a selected state during an effective scanning period which is a period other than the precharge period, at least once in each frame period, and the scanning signal line having been in the selected state during the effective scanning period is in a selected state during the precharge period, at least once in a period from a first point in time at which the scanning signal line is changed from the selected state to a non-selected state to a second point in time at which the scanning signal line goes into a selected state during an effective scanning period in a next frame period, wherein each of the plurality of pixel formation portions includes:

a switching element that is in an on state when a scanning signal line passing through a corresponding intersection point is in a selected state, and is in an off state when the scanning signal line is in a non-selected state; and a pixel capacitance connected, through the switching element, to a data signal line passing through the corresponding intersection point, and the precharge voltage is applied to each data signal line by the precharge circuit and each scanning signal line is selected by the scanning signal line driver circuit, such that a polarity of the precharge voltage provided to each data signal line when any one of the scanning signal lines is caused to be in a selected state during the precharge period in each frame period matches a polarity of a data signal applied to said data signal line when said scanning signal line is caused to be in a selected state during the effective scanning period in a next frame period.

19. The driver circuit according to claim 18, wherein the precharge circuit:

generates the precharge voltage to be provided to each data signal line, such that a polarity of the precharge voltage provided to each data signal line during each precharge period matches a polarity of a data signal applied to said data signal line immediately after the precharge period, and provides the precharge voltage to each data signal line using a predetermined period as the precharge period when a polarity of each data signal is reversed.

20. The driver circuit according to claim 18, wherein the data signal line driver circuit generates the plurality of data signals such that polarities of the data signals are reversed every two or more predetermined number of horizontal periods, and the precharge circuit provides the precharge voltage to the plurality of data signal lines during the precharge period, every horizontal period.

21. The driver circuit according to claim 18, wherein the data signal line, driver circuit generates the plurality of data signals such that data signals to be respectively applied to adjacent data signal lines have different polarities, the driver circuit includes a circuit for interrupting application of the plurality of data signals to the plurality of data signal lines during a predetermined period, every one or more predetermined number of horizontal periods, and short-circuiting the plurality of data signal lines during a predetermined charge sharing period included in the predetermined period, and the precharge period is included in the predetermined period during which the application of the plurality of data signals to the plurality of data signal lines is interrupted, and is a period following the charge sharing period.

22. The driver circuit according to claim 18, wherein the data signal line driver circuit includes:

a plurality of buffers for outputting the plurality of data signals to be applied to the plurality of data signal lines; and a pause control part for causing the plurality of buffers to pause during the precharge period.

23. A driving method for an active matrix-type liquid crystal display apparatus including a plurality of data signal lines; a plurality of scanning signal lines intersecting the plurality of data signal lines; and a plurality of pixel formation portions arranged in a matrix form so as to correspond to respective intersection points of the plurality of data signal lines and the plurality of scanning signal lines, the driving method comprising:

a data signal line driving step of generating a plurality of data signals representing an image to be displayed, as voltage signals whose polarities are reversed every predetermine number of horizontal periods, and applying the plurality of data signals to the plurality of data signal lines;

a precharging step of providing, as a precharge voltage, a predetermined positive-polarity or negative-polarity voltage to the plurality of data signal lines during a predetermined precharge period, every one or more predetermined number of horizontal periods; and a scanning signal line driving step of selectively driving the plurality of scanning signal lines such that each of the plurality of scanning signal lines is in a selected state during an effective scanning period which is a period other than the precharge period, at least once in each frame period, and the scanning signal line having been in the selected state during the effective scanning period is in a selected state during the precharge period, at least once in a period from a first point in time at which the scanning signal line is changed from the selected state to a non-selected state to a second point in time at which the scanning signal line goes into a selected state during an effective scanning period in a next frame period, wherein each of the plurality of pixel formation portions includes:

a switching element that is in an on state when a scanning signal line passing through a corresponding intersection point is in a selected state, and is in an off state when the scanning signal line is in a non-selected state; and a pixel capacitance connected, through the switching element, to a data signal line passing through the corresponding intersection point, and the precharge voltage is applied to each data signal line in the precharging step and each scanning signal line is selected in the scanning signal line driving step, such that a polarity of the precharge voltage provided to each data signal line when any one of the scanning signal lines is caused to be in a selected state during the precharge period in each frame period matches a polarity of a data signal applied to said data signal line when said scanning signal line is caused to be in a selected state during the effective scanning period in a next frame period.

24. The driving method according to claim 23, wherein in the precharging step, the precharge voltage to be provided to each data signal line is generated such that a polarity of the precharge voltage provided to each data signal line during each precharge period matches a polarity of a data signal applied to said data signal line immediately after the precharge period, and the precharge voltage is provided to each data signal line using a predetermined period as the precharge period when a polarity of each data signal is reversed.

25. The driving method according to claim 23, wherein in the data signal line driving step, the plurality of data signals are generated such that polarities of the data signals are reversed every two or more predetermined number of horizontal periods, and in the precharging step, the precharge voltage is provided to the plurality of data signal lines during the precharge period, every horizontal period.

26. The driving method according to claim 23, wherein the precharge period is shorter than a period during which the plurality of data signals representing the image are applied to the plurality of data signal lines.

27. The driving method according to claim 23, wherein each of the plurality of pixel formation portions is configured to form a black pixel when a voltage is not applied to a corresponding pixel capacitance, and the precharge voltage is a voltage corresponding to black display.

28. The driving method according to claim 23, further comprising:

a step of interrupting application of the plurality of data signals to the plurality of data signal lines during a predetermined period, every one or more predetermined number of horizontal periods, and short-circuiting the plurality of data signal lines during a predetermined charge sharing period included in the predetermined period, wherein in the data signal line driving step, the plurality of data signals are generated such that data signals to be respectively applied to adjacent data signal lines have different polarities, and the precharge period is included in the predetermined period during which the application of the plurality of data signals to the plurality of data signal lines is interrupted, and is a period following the charge sharing period.

29. The driving method according to claim 23, further comprising: a step of causing a plurality of buffers to pause during the precharge period, the buffers outputting the plurality of data signals to be applied to the plurality of data signal lines.

* * * * *